US006803717B2

(12) United States Patent
Ohnishi

(10) Patent No.: US 6,803,717 B2
(45) Date of Patent: Oct. 12, 2004

(54) IMAGE DISPLAYING APPARATUS HAVING A POTENTIAL REGULATING ELECTRODE, AN ANODE, AND A SPACING MEMBER, FOR SUPPRESSING UNDESIRED DISCHARGE

(75) Inventor: Tomoya Ohnishi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 10/002,291

(22) Filed: Dec. 5, 2001

(65) Prior Publication Data

US 2002/0084997 A1 Jul. 4, 2002

(30) Foreign Application Priority Data

Dec. 6, 2000 (JP) ..... 2000-371770
Dec. 3, 2001 (JP) ..... 2001-368681

(51) Int. Cl.[7] ..... H01J 1/62; H01J 63/04

(52) U.S. Cl. ..... 313/495; 313/496; 313/497; 313/500; 313/422; 445/24

(58) Field of Search ..... 313/495–497, 313/500, 422; 445/24

(56) References Cited

U.S. PATENT DOCUMENTS 5,760,538 A * 6/1998 Mitsutake et al. ..... 313/422
6,184,619 B1 * 2/2001 Yamazaki et al. ..... 313/495
6,486,610 B2 * 11/2002 Kojima et al. ..... 315/169.3

FOREIGN PATENT DOCUMENTS

EP 1117124 A2 * 7/2001 ..... H01J/31/12
JP 2000-235837 8/2000
JP 2000-251708 9/2000

* cited by examiner

*Primary Examiner*—Nimeshkumar D. Patel
*Assistant Examiner*—Sikha Roy
(74) *Attorney, Agent, or Firm*—Fitzpatrick, Cella, Harper & Scinto

(57) ABSTRACT

An image displaying apparatus capable of suppressing abnormal discharges includes the following components. That is, the image displaying apparatus includes a rear plate 1005 provided with electron beam sources; a face plate 1007 having an anode 1014 that includes an imaging area equipped with phosphor membrane 1008 emitting light by the irradiation of an electron beam and is regulated at an electric potential higher than those of the electron beam sources, and a potential regulating electrode 1015 that is situated at the outside of the anode 1014 for regulating the outside at a predetermined electric potential lower than that of the anode 1014; and spacers 1012 provided between the rear plate 1005 and the face plate 1007, wherein the image displaying apparatus has a structure such that the spacers 1012 contact both of the anode 1014 and the potential regulating electrode 1015 and electrodes are formed at the contacting portions.

27 Claims, 10 Drawing Sheets

PRIOR ART

PRIOR ART

IMAGE DISPLAYING APPARATUS HAVING A POTENTIAL REGULATING ELECTRODE, AN ANODE, AND A SPACING MEMBER, FOR SUPPRESSING UNDESIRED DISCHARGE

BACKGROUND OF THE INVENTION

1. Field of the Invention

The present invention relates to an image displaying apparatus utilizing an electron beam such as a field emission display (FED) and a cathode-ray tube (CRT).

2. Related Background Art

So far, image displaying apparatuses such as CRT's have always been required to have further larger screens, and research therefor is lively being performed. Moreover, as the screens become larger, it becomes an important problem to make the apparatuses thinner in thickness, lighter in weight, and lower in costs. However, because a CRT deflects electrons accelerated by a high voltage with the deflection electrode thereof to excite the phosphor on the face plate thereof, it becomes necessary to lengthen the depth thereof in principle, and then it becomes difficult to provide a CRT thin in thickness and light in weight. The present inventors have researched in respect of a surface conduction electron-emitting device and an image displaying apparatus using the surface conduction electron-emitting device as an image displaying apparatus capable of resolving such a problem.

For example, the inventors have tried to apply a multi-electron beam source by an electric wiring method shown in FIG. 11 to an image displaying apparatus. That is, the inventors have tried to compose an image displaying apparatus by using a multi-electron beam source in which many surface conduction electron-emitting devices are arranged two-dimensionally and the arranged surface conduction electron-emitting devices are wired in a passive matrix as shown in FIG. 11. In FIG. 11, a reference numeral 4001 designates a surface conduction electron-emitting device shown mimetically; a reference numeral 4002 designates a piece of wiring in a row direction; and a reference numeral 4003 designates a piece of wiring in a column direction. Incidentally, although a six by six matrix is shown in FIG. 11 on account of the convenience of description, the scale of the matrix is not limited to the six by six one, and devices necessary for displaying a desired image can be arranged.

FIG. 12 shows the structure of a cathode-ray tube using the multi-electron beam source. The structure comprises an outer housing bottom 4005 including a multi-electron beam source 4004, an outer housing frame 4007, and a face plate 4006 including a phosphor layer 4008 and a metal-backing 4009. Moreover, the phosphor layer 4008 on the face plate 4006 includes phosphor thereby excited by an electron beam to emit light, and a black matrix for suppressing the reflection of outer light to prevent color mixture in the phosphor. A high electric potential Va is applied to the phosphor layer 4008 and the metal-backing 4009 through a high voltage terminal 4011, and the phosphor layer 4008 and the metal-backing 4009 constitutes an anode.

For the outputting of a desired electron beam from the multi-electron beam source 4004 in which surface conduction electron-emitting devices 4001 are wired in a passive matrix, appropriate electric signals are applied to the pieces of wiring 4002 in row directions and the pieces of wiring 4003 in column directions of the multi-electron beam source 4004. For example, for the drive of the surface conduction electron-emitting devices 4001 in an arbitrary row of the matrix, a selection potential Vs is applied to the wiring 4002 in the row direction to be selected, and at the same time a nonselection potential Vns is applied to the wiring 4002 in the row directions not to be selected. Synchronously to this, a drive potential Ve for outputting electron beams is applied to the pieces of the wiring 4003 in the column directions.

By this method, the voltages Ve and Vs are applied to the surface conduction electron-emitting devices 4001 of the rows to be selected, and the voltages Ve and Vns are applied to the surface conduction electron-emitting devices 4001 of the rows not to be selected. By the settings of the voltages Ve, Vs and Vns to be appropriate potentials, electron beams having desired strength can be outputted only from the surface conduction electron-emitting devices 4001 of the rows to be selected. And, when drive potentials Ve having different strength from each other are applied to each of the wiring 4003 in the column directions, electron beams having different strength are outputted from each surface conduction electron-emitting devices 4001 in the row to be selected. Moreover, because the response speed of the surface conduction electron-emitting devices 4001 is high, the length of time during which electron beams are outputted can also be changed by the change of the length of time during which the drive potential Ve is applied.

By the application of such electric potentials, the electron beams outputted from the multi-electron beam source 4004 irradiate the metal-backing 4009, which the high electric potential Va is applied to, and excite the phosphor, or the target, to make the phosphor emit light. Moreover, in the image displaying apparatus, the high electric potential Va (sometimes referred to as an "accelerating potential" or an "anode potential") is applied to the metal-backing 4009 to generate an electric field between the outer housing bottom 4005 (sometimes referred to as a "rear plate") and the face plate 4006. Thereby, electrons emitted from the multi-electron beam source 4004 are accelerated and excite the phosphor to emit light. Consequently, an image is formed.

Now, because the brightness of an image displaying apparatus depends on an accelerating potential greatly, it is necessary to heighten the accelerating potential for the realization of high brightness. Moreover, because the thickness of an image displaying panel should be thinned for the realization of the thinning of the image displaying apparatus, the distance between the rear plate 4005 and the face plate 4006 should be shorten therefor. Consequently, a considerably high electric field is generated between the rear plate 4005 and the face plate 4006.

SUMMARY OF THE INVENTION

Now, in the structure equipped with an anode to which accelerating potential for accelerating an electron is applied, undesirable discharges are sometimes generated between the anode and other members.

The inventors of the present invention planned to dispose a potential regulating electrode capable of suppressing the discharge between the anode and any other member capable of generating a creeping discharge between the anode at a halfway point of a creepage between the anode and the other member.

As a result of the zealous consideration, the present inventors found a fact that the employment of a structure in which a further spacing member is disposed in the structure having the potential regulating electrode would cause the problem of an abnormal discharge owing to the existence of the spacing member.

One object of the invention is to realize a structure capable of suppressing undesirable discharges in a structure including an anode, a potential regulating electrode and a spacing member.

An image displaying apparatus according to the present invention is composed as follows. That is, an image displaying apparatus comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between the first and second plates, the spacing member contacting both of the anode and the potential regulating electrode, the spacing member including an electrode contacting or being disposed close to the potential regulating electrode thereby electrically coupled with the potential regulating electrode.

Moreover, in the aforesaid invention, a configuration in which the spacing member further includes an electrode contacting or being disposed close to the anode thereby electrically coupled with the anode is preferably employed.

Moreover, in each invention mentioned above, a configuration in which the spacing member further includes an electrode contacting or being disposed close to the electrode disposed on the first plate side thereby electrically connected with the electrode can preferably be employed.

As an electrode to be disposed on the first plate side, an electrode to be disposed on the first plate may be employed. As the electrode to be disposed on the first plate, wiring to be disposed on the first plate can be employed. In particular, the wiring supplying a signal for making the electron source emit an electron to an electron-emitting device may be employed.

Moreover, in each invention described above, a configuration to supply the earth potential to the potential regulating electrode or a configuration to supply an electric potential equal to the lowest electric potential among electric potentials supplied to the electron beam source or more may be employed.

Moreover, in each invention described above, a configuration may-preferably be employed where the anode include an image area in which a phosphor emitting light by being irradiated with electrons from the electron beam source; and when an averaged height of a portion of the anode contacting the spacing member on an outside of the image area is indicated by Da, and a surface roughness of the portion is indicated by Ra, and an averaged height of a portion of the potential regulating electrode contacting the spacing member is indicated by Db, and a surface roughness of the portion is indicated by Rb, the averaged heights Da and Db and the surface roughnesses Ra and Rb meet following conditions: $|Da-Db| \leqq 2Ra$, and $|Da-Db| \leqq 2Rb$. Incidentally, the height referred herein means the height of the contacting surface of the anode with the spacing member measured from a common reference surface (hereupon, the surface of the second plate).

Moreover, in each invention described above, a configuration may preferably be employed in which at least an area of the second plate between the anode and the potential regulating electrode has a sheet resistance within a range of $10^7$ (Ω/□) to $10^{14}$ (Ω/□).

Moreover, in each invention described above, a configuration may preferably be employed in which a high resistance membrane is formed at least in an area of the second plate between the anode and the potential regulating electrode.

Moreover, in each invention described above, a configuration may preferably be employed in which an area having a sheet resistance within a range of $10^7$ (Ω/□) to $10^{14}$ (Ω/□) exists on the spacing member at least between a portion thereof contacting the anode and a portion thereof contacting the potential regulating electrode.

Moreover, in each invention described above, a configuration may preferably be employed in which a high resistance membrane is formed on the spacing member at least between a portion thereof contacting the anode and a portion thereof contacting the potential regulating electrode.

Moreover, in each invention described above, a configuration may preferably be employed in which the spacing member includes an electrode contacting or being disposed close to the anode thereby electrically coupled with the anode and an electrode contacting or being disposed close to the potential regulating electrode thereby electrically connected with the potential regulating electrode; and an area between the electrode contacting or being disposed close to the anode thereby electrically coupled with the anode and the electrode contacting or being disposed close to the potential regulating electrode thereby electrically connected with the potential regulating electrode has a sheet resistance within a range of $10^7$ (Ω/□) to $10^{14}$ (Ω/□).

Moreover, in each invention described above, a configuration may preferably be employed in which the spacing member includes an electrode contacting or being disposed close to the anode thereby electrically coupled with the anode, an electrode contacting or being disposed close to the potential regulating electrode thereby electrically connected with the potential regulating electrode and a high resistance membrane contacting or being disposed close to each of the electrode contacting or being disposed close to the anode thereby electrically coupled with the anode and the electrode contacting or being disposed close to the potential regulating electrode thereby electrically connected with the potential regulating electrode thereby electrically connected with them.

Moreover, in each invention described above, a configuration may preferably be employed in which the spacing member includes an electrode contacting or being disposed close to the anode thereby electrically coupled with the anode and an electrode contacting or being disposed close to the potential regulating electrode thereby electrically connected with the potential regulating electrode; and an interval between the electrode contacting or being disposed close to the anode thereby electrically coupled with the anode and the electrode contacting or being disposed close to the potential regulating electrode thereby electrically connected with the potential regulating electrode is substantially the same as an interval between the anode and the potential regulating electrode. Hereupon, "substantially the same" means to be: (the interval between the anode and the potential regulating electrode)×0.8≦(the interval between the electrode contacting or being disposed close to the anode thereby electrically connected with the anode and the electrode contacting or being disposed close to the potential regulating electrode thereby electrically coupled with the potential regulating electrode)≦(the interval between the anode and the potential regulating electrode)×1.2.

Moreover, in each invention described above, a configuration may preferably be employed in which an interval between a projective position of an extreme point on the anode side of the potential regulating electrode to the spacing member and a position of an extreme point on the anode side of an electrode contacting or being disposed close to the potential regulating electrode of the spacing member to be electrically connected with the potential regulating electrode is ten percent or less of an interval between the potential regulating electrode and the anode. When the extreme point contacts the spacing member, the "projective position of an extreme point on the anode side of the potential regulating electrode to the spacing member" corresponds to the contacting point of the extreme point with the spacing member. That is, by the suppression of the positional shifting between the electrode formed on the spacer and the potential regulating electrode, discharges can preferably be suppressed.

Moreover, in each invention described above, a configuration may preferably be employed in which the spacing member includes an electrode contacting or being disposed close to the anode thereby electrically connected with the anode; and an interval between a projective position of an extreme point on the potential regulating electrode side of the anode to the spacing member and a position of an extreme point on the potential regulating electrode side of the electrode of the spacing member, the electrode contacting or being disposed close to the anode thereby electrically connected with the anode, is ten percent or less of an interval between the potential regulating electrode and the anode. When the extreme point contacts the spacing member, the "projective position of an extreme point on the potential regulating electrode side of the anode to the spacing member" corresponds to the contacting point of the extreme point with the spacing member.

Moreover, in each invention described above, a configuration may preferably be employed in which at least a part of the second plate and the spacing member contacts between the potential regulating electrode and the anode of the second plate.

Moreover, in each invention described above, a configuration may preferably be employed in which a structure contacting the spacing member is provided in an area between the anode and the potential regulating electrode of the second plate.

In this configuration, it is preferable to set the averaged heights Dc, Da and Db and the surface roughnesses Ra and Rb to meet at least one of following formulae: $|Da-Dc| \leqq 2Ra$, $|Db-Dc| \leqq 2Rb$, when an averaged height of the structure contacting the spacing member of the second plate is indicated by Dc, and an averaged height of a portion of the anode contacting the spacing member is indicated by Da, and a surface roughness of the portion is indicated by Ra, and an averaged height of a portion of the potential regulating electrode contacting the spacing member is indicated by Db, and a surface roughness of the portion is indicated by Rb.

Moreover, in each configuration described above, it is preferable that the structure contacting the spacing member of the second plate is composed of a high resistance material. Moreover, a configuration can preferably be employed in which a high resistance membrane having a volume resistivity lower than that of the structure is formed on a surface of the structure contacting the spacing member of the second plate.

Moreover, in each invention described above, a configuration may preferably be employed in which the spacing member has a structure for contacting an area between the anode and the potential regulating electrode of the second plate. In this case, a configuration may preferably be employed in which the structure of the spacing member for contacting the area between the anode and the potential regulating electrode of the second plate is a projecting configuration.

Moreover, in each invention described above, a configuration may preferably be employed in which the spacing member includes a high resistance membrane. In this case, it is preferable that a sheet resistance of the high resistance membranes of the spacing member is within a range of $1\times10^{7}$ (Ω/□) to $1\times10^{14}$ (Ω/□).

Moreover, in each invention described above, a configuration may preferably be employed in which the electron beam source provided on the first plate is disposed in a matrix. Moreover, it is preferable that the electron beam source is composed of surface conduction electron-emitting devices.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DETAILED DESCRIPTION OF THE PREFERRED EMBODIMENTS

Hereinafter, embodiments of the present invention are described.

At first, how an unpreferable discharge is generated is concretely described. The inside of an image displaying apparatus displaying an image by the use of electrons is desired to be in a high vacuum. To put it concretely, the inside is desired to be kept at a pressure lower than about $1\times10^{-4}$ (Pa). For keeping the lower pressure state, a getter (not shown) is sometimes formed on the outside of an image displaying area. As the getter, for example, a Ba-evaporating type is used. A getter membrane is for keeping the degree of vacuum is formed by disposing a getter member and a supporting body on the outside of the image displaying area, and by sealing the image displaying panel as a vacuum chamber, and after that by scattering Ba by means of high frequency heating or the like.

However, as described above, an acceleration potential is applied to the image displaying area of the face plate, and a high electric field is generated between the rear plate and the face plate. Moreover, the electric potential on the outside of the image displaying area on the face plate is sometimes raised even if a voltage is not directly applied to the outside. There is a problem such that, once an electric field has been generated on the outside of the image displaying area, discharges are generated from the parts such as the getter member, a getter supporting body and a supporting member 4013 of an atmospheric pressure supporting mechanism, to which an electric field tends to converge, and then the discharges make an image quality remarkably deteriorated.

Figure 13:
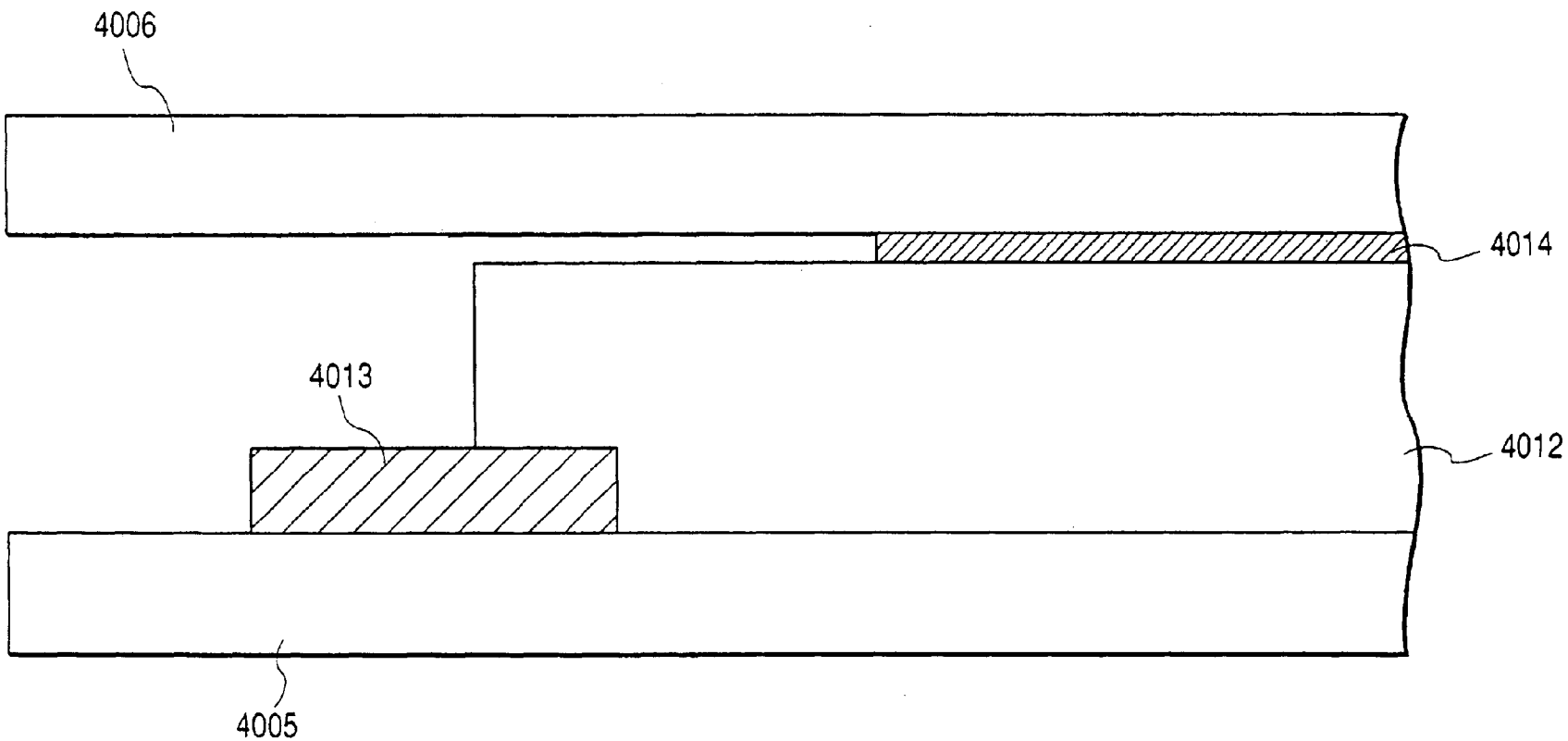
PRIOR ART FIG. 13
FIG. 13 is a mimetic cross section showing a conventional atmospheric pressure supporting mechanism of the image displaying apparatus.
Figure 2:
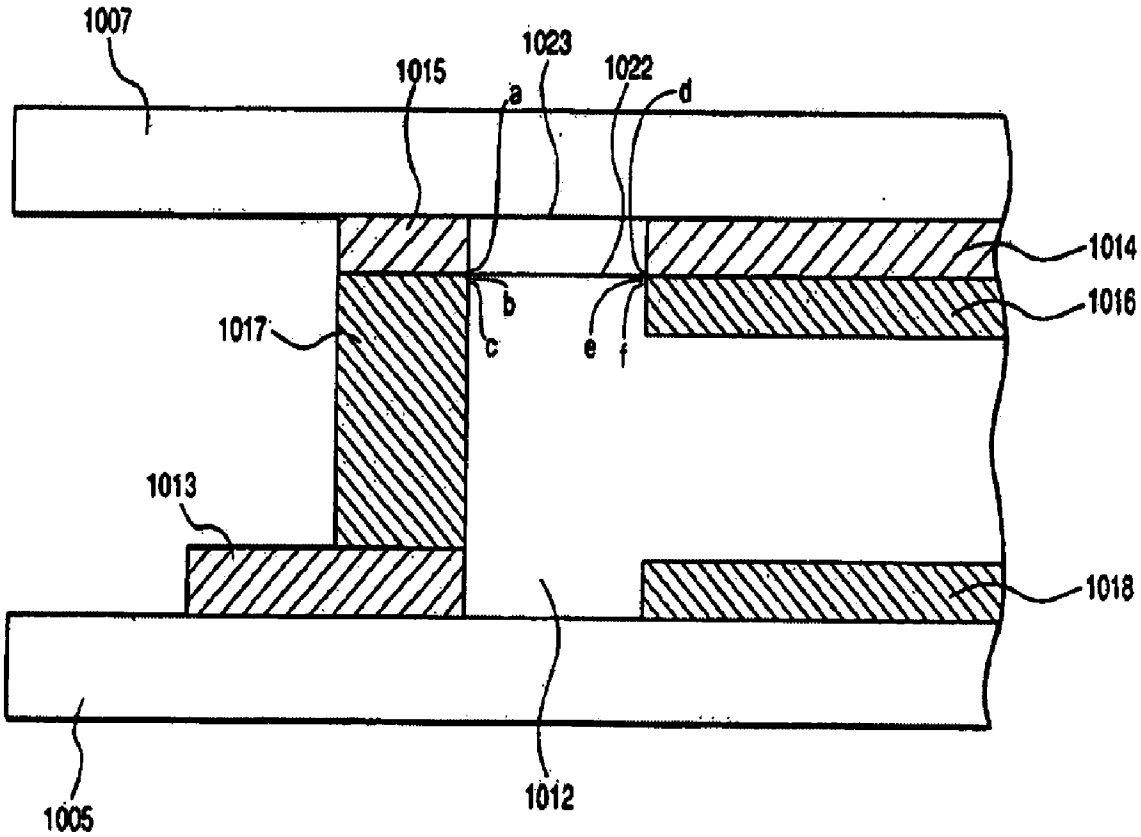
Figure 11:
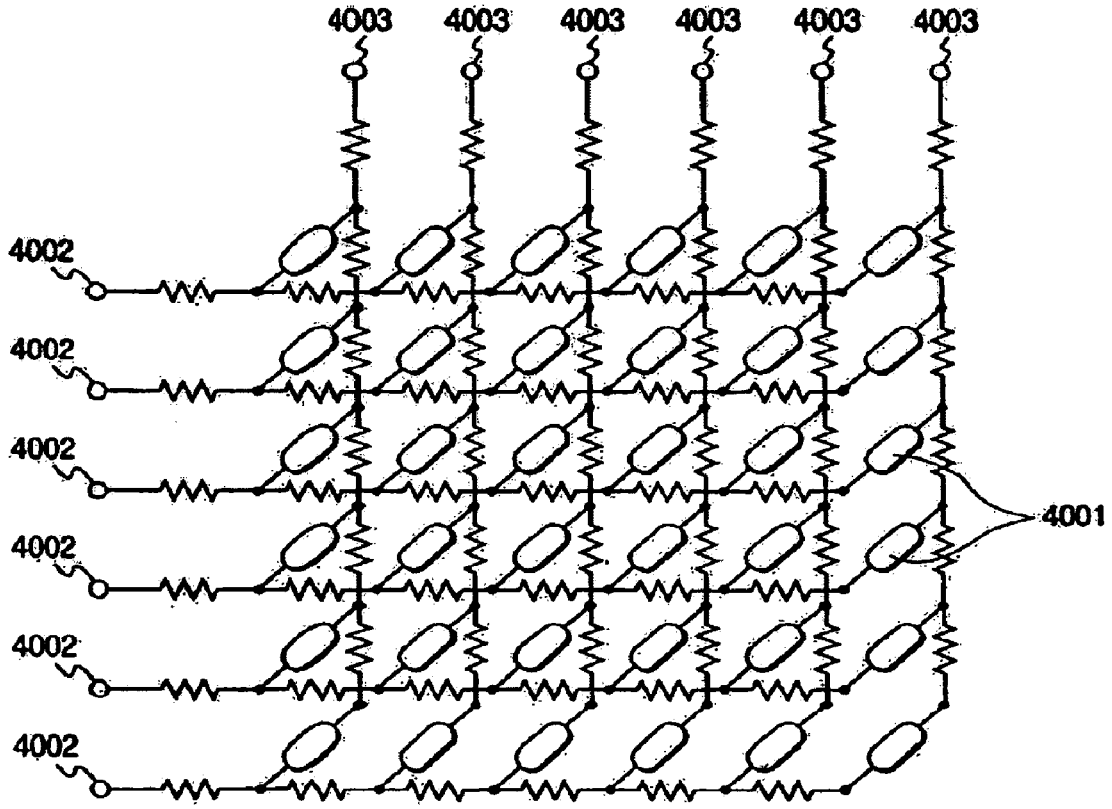
FIG. 11 PRIOR ART
Figure 12:
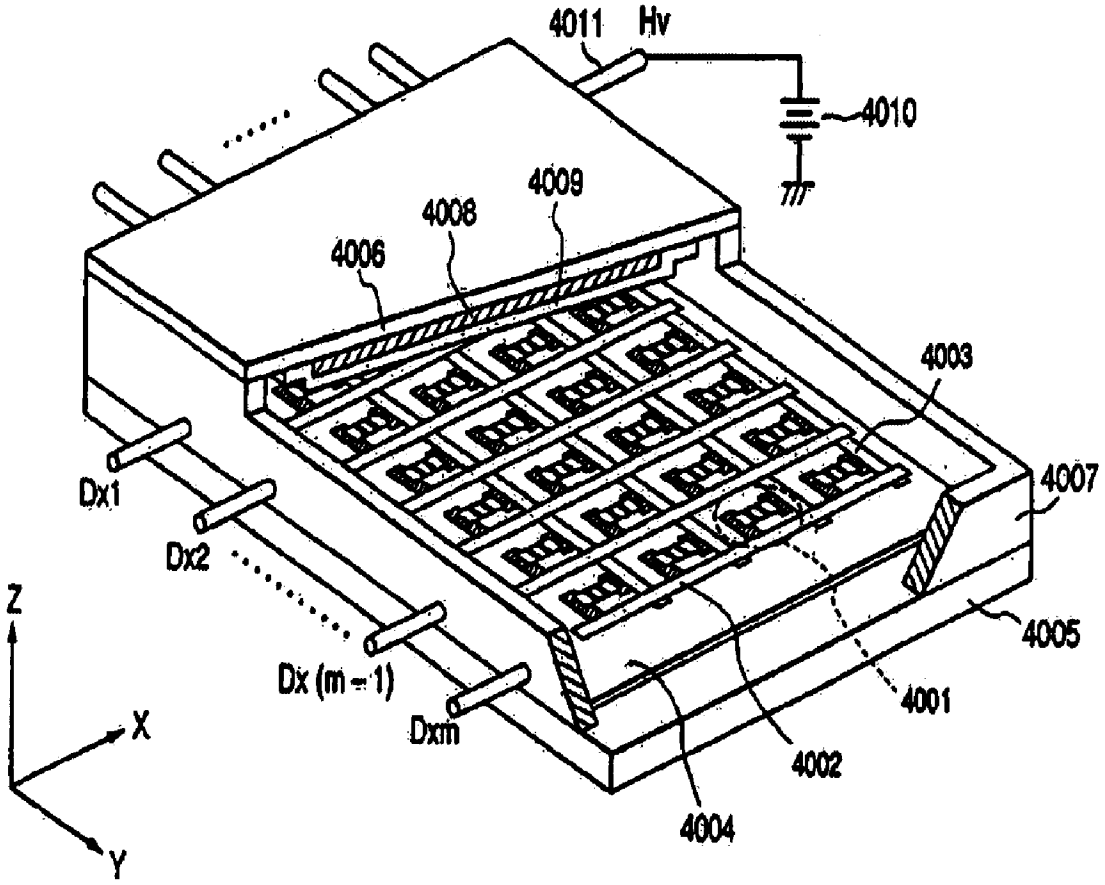
FIG. 12 PRIOR ART
Figure 13:
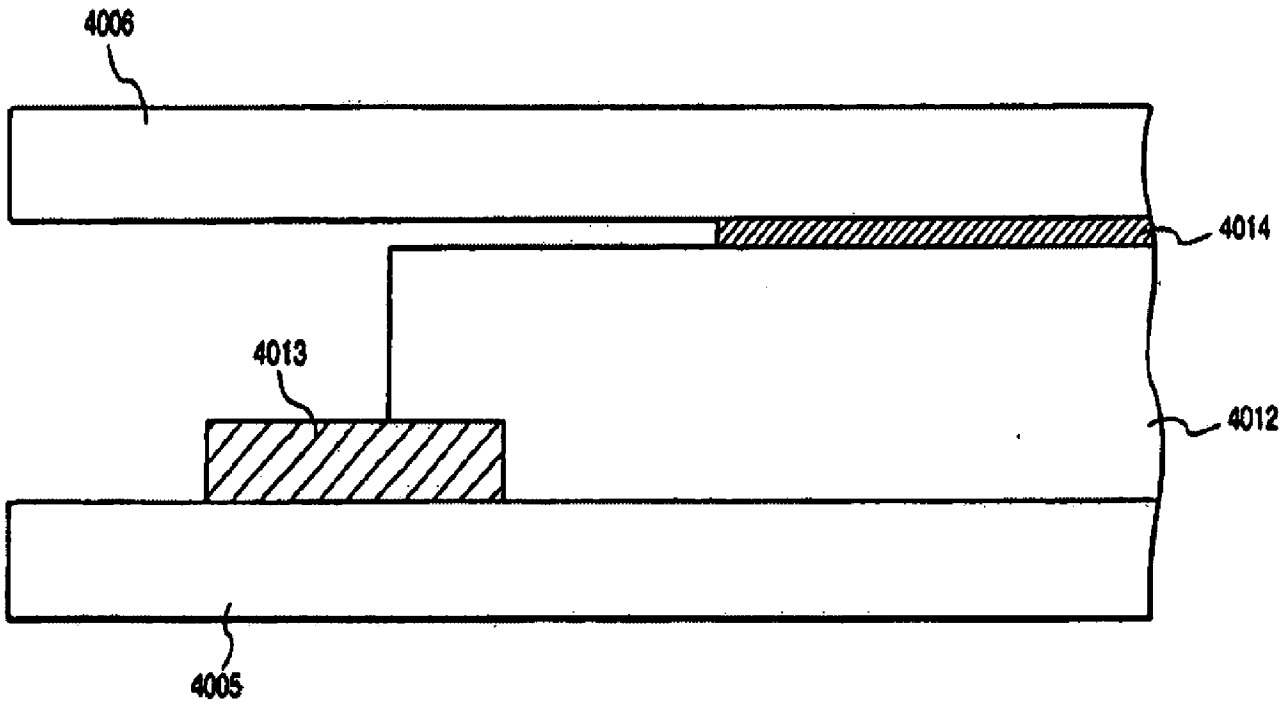
FIG. 13 PRIOR ART

Moreover, when an image displaying apparatus is formed, the inside of the image displaying panel should be in a high vacuum. Now, an structure equipped with a spacing member for keeping the spacing area in the inside of an image displaying apparatus in a desired state even if there is a large pressure difference between the inside and the outside of the apparatus is suitable for realizing the image displaying apparatus thin in thickness and large in screen size under the condition of the existence of the pressure difference. As for the spacing member (atmospheric pressure supporting mechanism), a cylindrical member, a thin plate-like member, or the like is used. When the plate-like atmospheric pressure supporting mechanism is used, such a structure as shown in FIG. 13 is sometimes employed, in which the supporting member 4013 is located at the outside of the area of an anode 4014 and an atmospheric pressure supporting mechanism 4012 is situated between the rear plate 4005 and the face plate 4006.

When the supporting member 4013 of the atmospheric pressure supporting mechanism 4012 is located at the inside of the area of the anode 4014, there is the possibility of the occurrence of the problem of the concentration of the electric field surrounding the supporting member 4013, which brings about a discharge. The supporting member 4013 is sometimes located at the outside of the image displaying area accordingly. Hereupon, the atmospheric pressure supporting mechanism 4012 adjoins to the anode 4014.

As described above, there is the possibility of the occurrence of a discharge between the anode 4014 and the getter or the getter supporting body, or between the anode 4014 and a member for supporting the spacing member. Moreover, there is the possibility of the occurrence of a creeping discharge between the anode 4014 and the vicinities thereof. The present invention employs a structure in which a potential regulating electrode is disposed with a space from the anode 4014 as a structure capable of suppressing such undesirable discharges. Incidentally, the anode 4014 is composed of a phosphor, a black matrix, a metal-backing and the like, and has the thickness of the order from several micrometers to scores of micrometers (the thickness viewed from the face plate 4006 of a glass substrate). Consequently, the atmospheric pressure supporting mechanism 4012 does not contact the face plate 4006 on the outside of the anode 4014 to form a small gap sometimes. However, when the materials and the structures of the atmospheric pressure supporting mechanism 4012 and the face plate 4006 are different from each other, a potential difference is generated between both of the sides of the small gap, and a considerably strong electric field is generated because of the smallness of the gap. Consequently, there is the problem such that a discharge is generated to cause the deterioration of an image quality. Even if a potential regulating electrode is supplied, a gap that could be formed between the potential regulating electrode and the atmospheric pressure supporting mechanism would generate a discharge therein.

Accordingly, in the present invention, a potential regulating electrode is supplied, and further the potential regulating electrode is made to contact a spacing member.

Incidentally, there is a case where surfaces planned to contact do not completely contact owing to the existence of errors on designing, errors on assembling or the unevenness (roughness) of contacting surfaces in the structure of contacting the potential regulating electrode with the spacing member. For example, when the surfaces to be planned to contact contact at only a part and the other parts of the surfaces do not contact, there is the possibility that the not contacting parts have different electric potentials though they are close to each other. Accordingly, the present invention suppresses abnormal discharges by providing an electrode (low resistance membrane) on the spacing member and by contacting the electrode with the potential regulating electrode or by placing the electrode near to the potential regulating electrode to connect the electrode with the potential regulating electrode electrically.

Hereinafter, the attached drawings are referred while the embodiments of the present invention are described in detail.

First Embodiment

Figure 1:
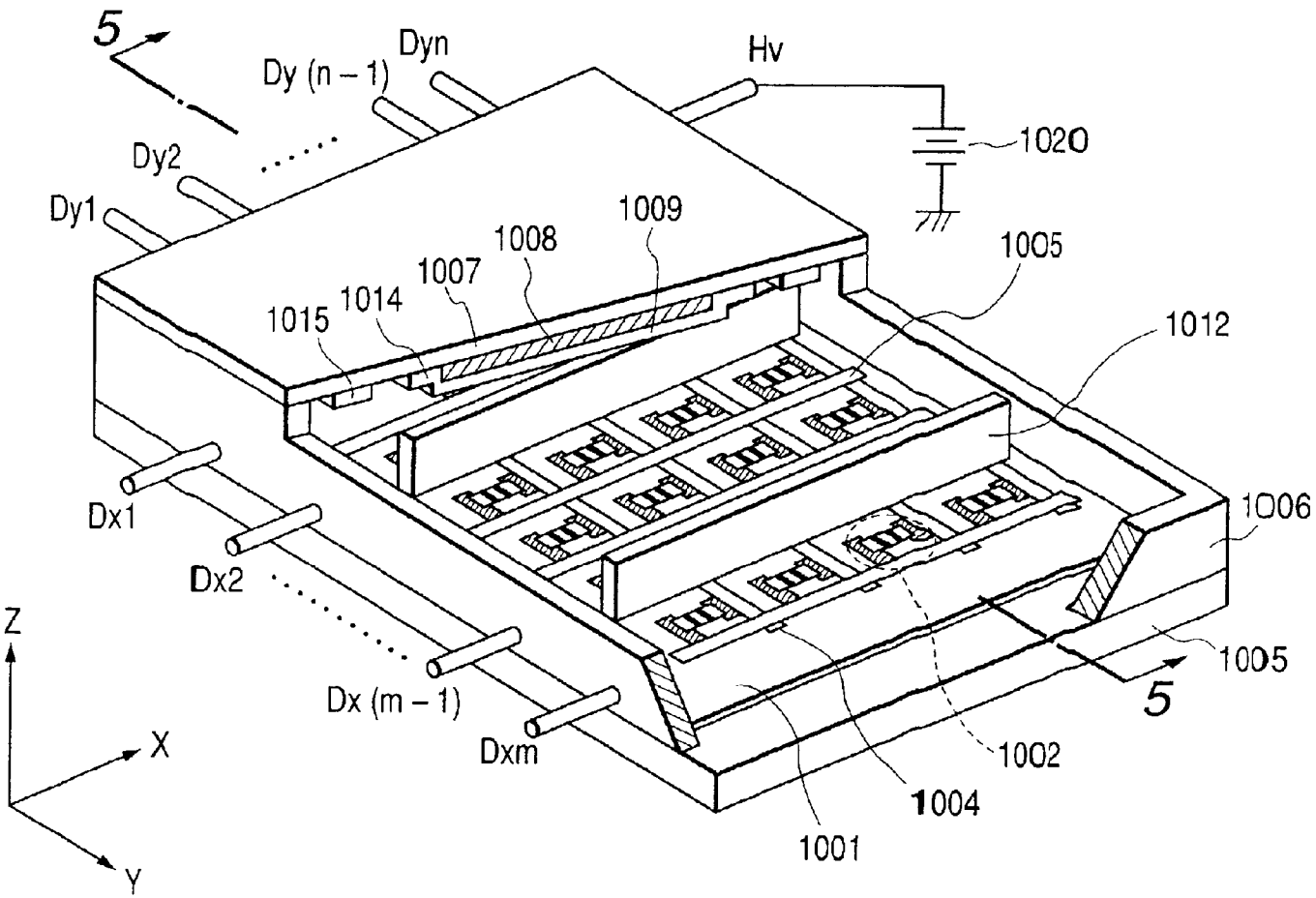
FIG. 1 is a partially broken perspective view showing the structure of a first embodiment of an image displaying apparatus according to the present invention.

FIG. 1 is a perspective view showing the structure of a fist embodiment of the image displaying apparatus of the present invention. Incidentally, FIG. 1 shows the image displaying apparatus with a part of an image displaying panel thereof being broken for the sake of displaying the inside structure thereof. In FIG. 1, a reference numeral 1005 designates an outer container (rear plate); a reference numeral 1006 designates a side wall; and a reference numeral 1007 designates a face plate. The rear plate 1005, the side wall 1006 and the face plate 1007 constitute a hermetic package for maintaining the inside of the image displaying panel in a vacuum.

The rear plate 1005 is provided with a substrate 1001, and a plurality of surface conduction electron-emitting devices 1002 are formed in a matrix on the substrate 1001. On the face plate 1007 are formed a phosphor membrane 1008 and a metal-backing 1009. Moreover, spacers (atmospheric pressure supporting mechanisms) 1012 are formed between the rear plate 1005 and the face plate 1007 in the Y-direction at a predetermined interval. Incidentally, a detailed description will be given later to the positional relation between the structure of the principal part such as an anode 1014, a potential regulating electrode 1015 and the like and the spacers 1012.

When the hermetic package is assembled, it is required to perform the seal bonding of the joining part of each member for the maintenance of the sufficient strength and the sufficient airtightness property of the joining part. Hereupon, the seal bonding is achieved by the coating of frit glass on the joining parts and by the burning of the frit glass at 400–500 degrees Celsius for ten minutes or more in the air or in a nitrogen atmosphere. A method for exhausting the inside of the hermetic package to a vacuum will be described later. Moreover, the inside of the hermetic package is maintained to be a vacuum of the order of $10^{-4}$ (Pa). As the displaying area of the image displaying apparatus becomes large, means for preventing the deformation or the destruction of the rear plate 1005 and the face plate 1007 owing to the pressure difference between the inside and the outside of the hermetic package becomes necessary.

A method of thickening the thicknesses of the rear plate 1005 and the face plate 1007 is not preferable because the method not only increases the weight of the image displaying apparatus, but also generates the distortion and the parallax of an image when the image is seen from an oblique direction. On the contrary, the present embodiment is provided with the spacers 1012, made of relatively thin glass plates or the like, for bearing the atmospheric pressure between the rear plate 1005 and the face plate 1007 as described above. By the employment of the structure, the space between the substrate 1001, on which a multi-electron beam source is formed, and the face plate 1007, on which the phosphor membrane 1008 is formed, is ordinary maintained on the order of a submillimeter to a few millimeters, and the inside of the hermetic package is kept to be a high vacuum, and further the deformation and the destruction of package can be prevented.

In this embodiment, the substrate 1001 is fixed on the rear plate 1005, and on the substrate 1001 N×M surface conduction electron-emitting devices 1002 are formed. (N and M are positive integers of 2 or more, and N and M are suitably set according to the number of the pixels being objects to be displayed. N is set to 1,440 and M is set to 480 in the present embodiment.) The N×M surface conduction electron-emitting devices are wired in a passive matrix with M pieces of wiring 1003 in the row directions and N pieces of wiring 1004 in the column directions. A portion composed of the substrate 1001, the electron emitting devices 1002, the wiring 1003 in the row directions and the wiring 1004 in the column directions is called as the multi-electron beam source.

The present embodiment has a structure in which the substrate 1001 of the multi-electron beam source is fixed on the rear plate 1005 of the hermetic package. However, when the substrate 1001 of the multi-electron beam source has sufficient strength, the substrate 1001 of the multi-electron beam source itself may be used as the rear plate 1005 of the hermetic package. Moreover, reference marks Dx1-Dxm, Dy1-Dyn and Hv designate terminals of the hermetic package for the electric connection of the image displaying panel with a not shown electric circuit. The terminals Dx1-Dxm are connected with the wiring 1003 in the row directions; the terminals Dy1-Dyn are connected with the wiring 1004 in the column directions; and the terminal Hv is connected with the anode 1014 including the metal-backing 1009 of the face plate 1007.

Moreover, the exhaustion of the inside of the hermetic package to a vacuum is performed with a vacuum pump connected with a not shown exhaust pipe to the degree of vacuum in the order of $10^{-6}$ (Pa) after the assembly of the hermetic package. After that, when the exhaust pipe is sealed, a getter membrane is formed at a predetermined position in the hermetic package immediately before or after the sealing for the sake of the maintenance of the degree of vacuum in the hermetic package. The getter membrane is a membrane formed by the heating and the evaporation of a getter material the principal component of which is, for example, Ba with a heater or by high-frequency heating, and the inside of the hermetic package is maintained at the vacuum of $1\times10^{-3}$ (Torr) to $1\times10^{-5}$ (Torr) owing to the absorption operation of the getter membrane.

Figure 2:
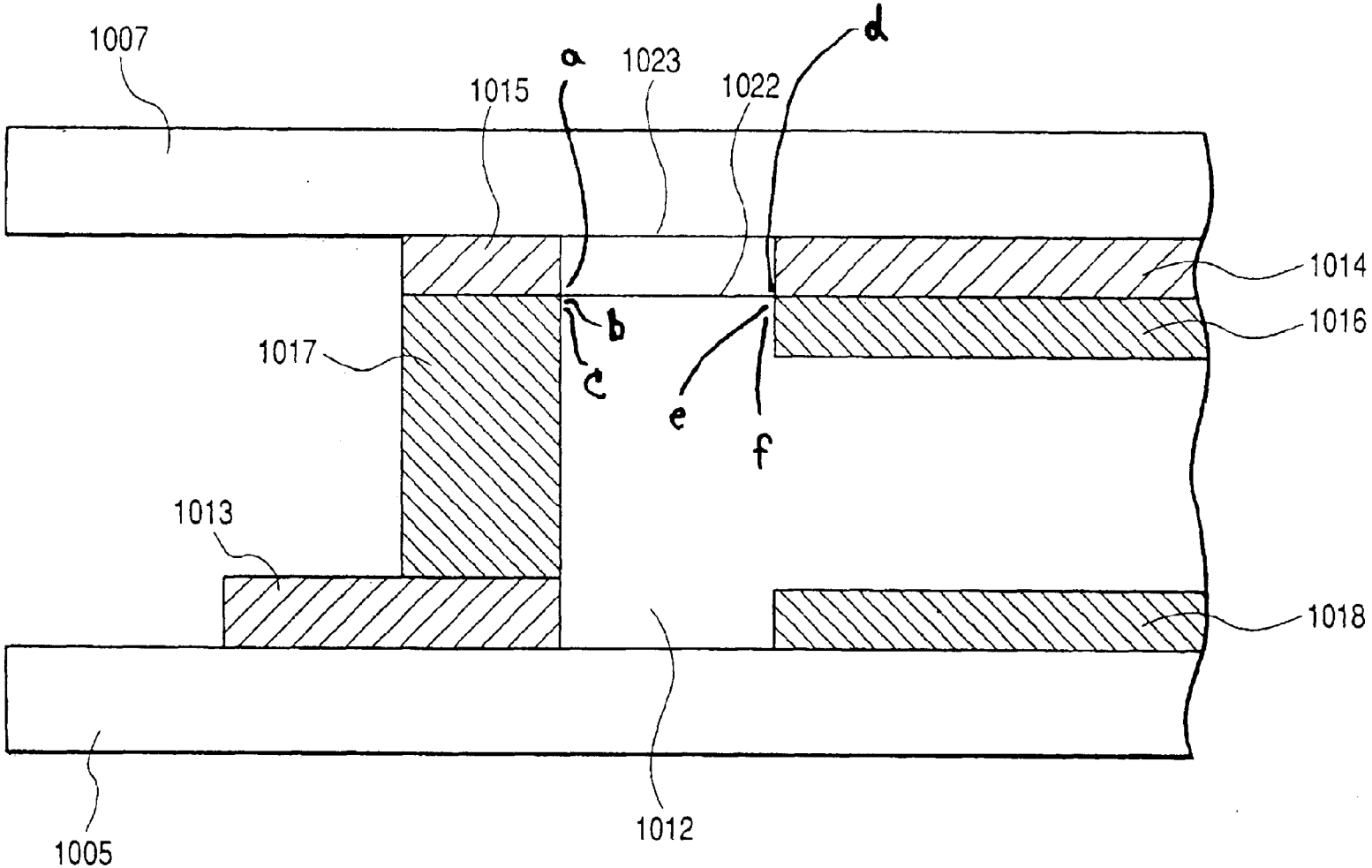
FIG. 2 is a mimetic cross section showing the structure of the principal part of the first embodiment of the invention.

Next, the structure of the principal part of the image displaying apparatus of the present embodiment is described. FIG. 2 is a mimetic cross section showing the peripheral structure of a spacer 1012 of the image displaying apparatus of FIG. 1 in detail. FIG. 2 is a cross section of a portion where the spacer 1012 adjoins a spacer fixing member 1013 when the portion is viewed from a direction orthogonal to the lengthwise direction of the spacer 1012. Incidentally, in FIG. 2, the same parts as those of FIG. 1 are designated by the same reference numerals as those of FIG. 1. In FIG. 2, at first, the rear plate 1005, the face plate 1007 and the spacer 1012 are the same ones as those of FIG. 1.

In FIG. 2, the following reference identifiers identify the following associated elements:

a-an extreme point on a side of a potential regulating electrode 1015;

b-a projected position of the extreme point a to the spacing member;

c-an extreme point (b coincides with c in the drawing) of the electrode 1017 (an electrode electrically connected to the potential regulating electrode) of the spacing member;

d-an extreme point on the potential regulating electrode side of the anode;

e-a projection position of the extreme point d to the spacing member; and f-an extreme point (e coincides with f in the drawing) on the potential regulating member of an electrode 1016 (an electrode connected electrically to the anode) of the spacing member.

The anode 1014 and the potential regulating electrode 1015 are formed on the face plate 1007, and the accelerating potential Va is applied to the anode 1014 from a high voltage power source. The potential regulating electrode 1015 is connected with the ground potential. The spacer 1012 is extended from the area of the anode 1014 to the outside. The spacer 1012 contacts the anode 1014 and the potential regulating electrode 1015 on the face plate 1007. Moreover, the spacer 1012 is fixed at a predetermined position on the rear plate 1005 by the spacer fixing member 1013.

The spacer 1012 is provided with electrodes 1016, 1017 and 1018 that are formed in contact with or in the vicinity of the electrodes (wiring) in the image displaying area of the anode 1014, the potential regulating electrode 1015 and the rear plate 1005, and are electrically connected with each of the wiring formed on the anode 1014, the potential regulating electrode 1015 and the rear plate 1005. Incidentally, "an electrode formed on the spacer being a spacing member is electrically connected with another electrode in contact with or in the vicinity of the other electrode" indicates a case where the two electrodes is electrically connected in contact with each other or a case where a substantially low resistance member exists between the two electrode being close to each other to connect them electrically. For example, a case where a high resistance membrane is formed on the spacer 1012 is considered, which will be described later. It is needless to say that a case where a low resistance membrane (electrode) is formed on the high resistance membrane contacting the other electrode is included. On the other hand, in the case where the electrode (low resistance membrane) is first formed and the high resistance membrane is formed on the low resistance membrane, the electrode contacts other low resistance members (such as the anode 1014, the potential regulating electrode 1015 and the rear plate 1005), but the electrode is electrically connected with them through the high resistance membrane. Incidentally, in this case, although the intermediate membrane is high resistance membrane, only the resistance in the thickness direction is worth considering between the electrodes. For example, if the thickness of the high resistance membrane is 1 $\mu$m or less, the resistance membrane can substantially be regarded as a low resistance member in the thickness direction, and consequently sufficient electrical connection between the electrodes can be realized. The present invention includes such a case.

Incidentally, in the present embodiment, the spacers 1012 are disposed on the pieces of wiring in the X-directions (the pieces of wiring 1003 in the row directions) on the rear plate 1005 in the image displaying area in contact with the pieces of the wiring 1003, and the electrodes 1018 are regulated by the electric potentials of the pieces of the wiring on the X-directions. Moreover, in the present embodiment, the electrodes 1017 contact both of the face plate 1007 and the rear plate 1005. Consequently, although the electrodes 1017 are coupled with the earth on the side of the face plate 1007 (the fact will be described later), the electrodes 1017 can be coupled with the earth on the side of the rear plate 1005 when it is difficult to connect them with the earth on the side of the face plate 1007.

Figure 3A:
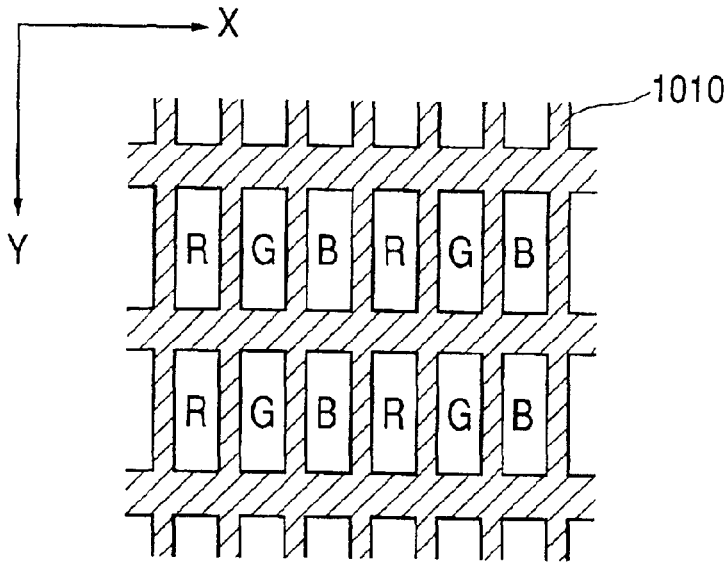
FIGS. 3A and 3B are mimetic plan views showing a phosphor arrangement of an image displaying panel.

Moreover, the anode 1014 contains red, green and black (RGB) phosphors for color displaying. The phosphors are separately coated at opened portions of a black matrix 1010 as they are shown in FIG. 3A. Moreover, a metal-backing covers their outsides (the inside of the hermetic package). Incidentally, the anode 1014 is a portion to which the acceleration potential is supplied, and the anode 1014 includes a good conducting material for the suitable supply of the acceleration potential over the whole area of the anode 1014. In the present embodiment, the metal-backing 1009 corresponds to the good conducting material. Moreover, in the present embodiment, the good conducting material is disposed at a peripheral portion of the anode 1014. The peripheral portion substantially regulates the outer periphery of the anode 1014. Moreover, the acceleration potential is supplied to the peripheral portion from the outside of the hermetic package, and then the acceleration potential is supplied to the whole area of the anode 1014 through the peripheral portion and the metal-backing 1009. Moreover, in the embodiment, the anode 1014 includes the black matrix 1010. The spacers 1012 are disposed on the parts in the X-directions of the black matrix 1010 in contact with them. Moreover, the potential regulating electrode 1015 is connected with the earth potential. Incidentally, although a plurality of spacers 1012 are provided as shown in FIG. 1 and it is preferable that all of them contact the potential regulating electrode 1015, it could be acceptable that at least one of them contacts the potential regulating electrode 1015.

Now, as described above, the heights of the anode 1014 and the potential regulating electrode 1015 from the surface of the substrate of the face plate 1007 are made to be substantially equal. Moreover, the spacers 1012 contact both of the electrodes. When the present inventors observed the image displaying panel by analyzing the panel after its assembly to a panel and the suction of its inside to a vacuum, the inventors could observe the traces such that the contacting portions of the electrode of the anode 1014 and the potential regulating electrode 1015 with the spacers 1012 had been pressed by the atmospheric pressure and thereby the materials of the electrodes are crushed. It proves that those portions surely contacted. Moreover, before assembling the image displaying panel with the spacers 1012, the rear plate 1005 and the face plate 1007, the inventors measured averaged heights at the black matrix 1010 outside the image displaying area in the vicinity of the contacting points of the spacers 1012 with a contacting type surface roughness tester. The results were that the height was 10.2 micrometers and the surface roughness was Ra=1.5 micrometers. Moreover, when the inventors measured averaged heights at the potential regulating electrode 1015 in the vicinity of the contacting points of the spacers 1012 with the contacting type surface roughness tester, the inventors obtained the results that the height was 9.5 micrometers and the surface roughness was Ra=1.3 micrometers. Incidentally, it was proved that the existence of the metal-backing 1009 formed on the black matrix 1010 scarcely influences the contact of the spacing members with the anode 1014 because the metal-backing 1009 was sufficiently thin and the metal-backing 1009 was easily crushed by its contact with the spacing members. That is, when the evaluation of the anode 1014 is performed, the metal-backing 1009 is neglected. However, in case that the metal backing has an effective thickness, the thickness should be taken into consideration.

Moreover, a space of 10 micrometers (small gap) exists between an area 1023 between the anode 1014 and the potential regulating electrode 1015 on the face plate 1007 and an area 1022 between a contact area of a spacer 1012 with the anode 1014 and a contact area of the spacer 1012 with the potential regulating electrode 1015. A high resistance membrane (the material and the method of producing the membrane will be described later) is formed at the area 1023, and potentials between the anode 1014 and the potential regulating electrode 1015 are divided by resistance division to define the potential at each position. Moreover, a high resistance membrane (the material and the method of producing the membrane will be described later) is formed on the spacer 1012, and potentials between the contact area with the anode 1014 and the contact area with the potential regulating electrode 1015 are divided by resistance division to define the potential at each position.

Incidentally, although not all the contact area of the spacer 1012 with the anode 1014 contacts the anode 1014, the electric potential of the contact area can substantially be the same as that of the anode 1014 because an electrode is formed on the spacer 1012 in such a way that the forming area of the electrode agrees with the contact area. Moreover, although not all the contact area of the spacer 1012 with the potential regulating electrode 1015 contacts the electrode 1015, the electric potential of the contact area can substantially be the same as that of the potential regulating electrode 1015 because an electrode is formed on the spacer 1012 in such a way that the forming area of the electrode agrees with the contact area. Consequently, the distance on the spacer 1012 between the electrode having substantially the same potential as that of the anode 1014 and the electrode having substantially the same potential as that of the potential regulating electrode 1015 is set to be the same as the distance between the anode 1014 and the potential regulating electrode 1015. Actually, the difference between the distances could be within a range of 20%. Moreover, attention is paid to the accuracy of the distances, and the amount of the discrepancy in the positions of the end portion of the anode 1014 on the side of the potential regulating electrode 1015 and the end portion of the electrode on the spacer 1012 having substantially the same potential as that of the anode 1014 is set to be within a range of 10% or less of the distance between the anode 1014 and the potential regulating electrode 1015. The amount of the discrepancy in the positions of the potential regulating electrode 1015 and the electrode on the spacer 1012 having substantially the same potential as that of the potential regulating electrode 1015 is also set similarly.

By the aforesaid setting, the distance between the anode 1014 and the potential regulating electrode 1015 in the area 1022 and the distance between the anode 1014 and the potential regulating electrode 1015 in the area 1023 can be made substantially the same, and thereby the electric potentials at opposed parts in the areas 1022 and 1023 (the parts where the distance between the areas 1022 and 1023 becomes nearest) can be made substantially the same. Consequently, potential differences are hard to generate at small gaps, and thereby high electric fields are hard to generate. When the image displaying apparatus in such a structure was driven at an accelerating potential Va=10 kV, no discharge was observed, and it was ascertained that the image displaying apparatus could display in a good image quality. Moreover, when an accelerating potential Va was not applied to the anode 1014 and a voltage Vb at which the image displaying apparatus began discharging as the gradual increase of the accelerating voltage Va in the state in which the multi-electron beam source was not driven was obtained, the voltage Vb was 14.5 kV. Incidentally, the distance between the anode 1014 and the potential regulating electrode 1015 was 2 mm, which will be described later.

Next, the multi-electric beam source to be used as the image displaying panel is described. The material, the shape and the manufacturing method of the multi-electron beam source to be used in the image displaying apparatus of the present embodiment are not restricted, and any material, shape and method will do as long as the multi-electron beam source is an electron source composed of cold-cathode devices disposed in a passive matrix disposition or a ladder-like disposition. Accordingly, for example, a surface conduction electron-emitting device, and an FE type, an MIM type or another type cold-cathode device can be used. However, under the condition that a image displaying apparatus having a large display screen and being cheap is required, the surface conduction electron-emitting device is especially desirable among the cold-cathode devices.

That is, the FE type cold cathode device requires an extremely precise manufacturing technique because the relative position and the shapes of its emitter corn and its gate electrode greatly influence its electron emitting characteristic. The fact becomes a disadvantageous factor for the realization of the enlargement of its screen area and the decrease of its manufacturing cost. Moreover, it is required that the membranes of its insulator layer and its upper electrode are thin and unique in the MIM type cold cathode device, and this is also a disadvantageous factor for the realization of the enlargement of its screen area and the decrease of its manufacturing cost. About these points, because the manufacturing method of the surface conduction electron-emitting device is relatively simple, it is easy to enlarge its screen area and decrease its manufacturing cost.

Moreover, the inventors of the present invention found that a surface conduction electron-emitting device having an electron emitting portion or its peripheral portion that were formed with a fine particle membrane had a superior electron emitting characteristic and was easily manufactured. Consequently, the surface conduction electron-emitting device is most suitable for the use of the multi-electron beam source of an image displaying apparatus. Accordingly, the image displaying panel of the present embodiment uses the surface conduction electron-emitting device having the electron emitting portion or its peripheral portion that are formed with a fine particle membrane.

Next, the structure and a manufacturing method of the face plate 1007 to be used for the image displaying panel are described by the use of concrete examples. As the substrate of the face plate 1007, for example, such glasses as soda lime glass, glass containing few impurities such as Na or the like, glass containing an alkali earth metal as a component for increasing its electrical insulating quality (e.g. PD 200 made by Asahi Glass Co., Ltd.) can be used. In the present embodiment, PD 200 made by Asahi Glass Co., Ltd. is used. The manufacturing method is as follows. After the washing and the drying of the substrate of PD 200, the black matrix 1010 is formed as a matrix shown in FIG. 3A by a screen printing method based on a designed value of its thickness of 10 micrometers in the image displaying area by the use of a black pigment paste including a glass paste and a black pigment. The black matrix 1010 is formed in order to prevent the color mixture of phosphors, and to prevent color shifting owing to the small divergences of beams, and further to absorb outside light for the improvement of an image contrast.

Figure 3B:
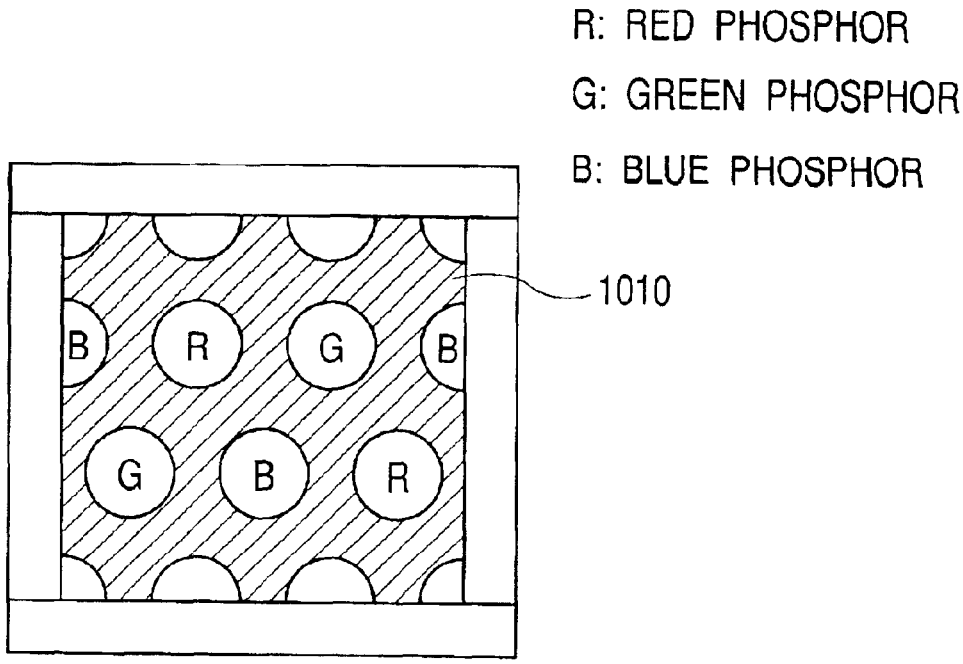

Although, in the present embodiment, the black matrix 1010 is made by the screen printing method, it is of course that the producing method is not limited to the method, and for example, a photolithography method may be employed. Moreover, although the black pigment paste including the glass paste and the black pigment is used as the material of the black matrix 1010, it is needless to say that the material is not limited to the black pigment paste. For example, carbon black or the like may be used. Furthermore, although the black matrix 1010 is made in the shape of the matrix shown in FIG. 3A, it is needless to say that the shape is not limited to the matrix. A delta-like arrangement shown in FIG. 3B, a strip-like arrangement (not shown) or other arrangements may be employed.

Moreover, the high resistance membrane is formed at the portion of the area 1023 between the anode 1014 and the potential regulating electrode 1015 on the face plate 1007. In the present embodiment, the high resistance membrane is made from WGeN which will be described later. The conditions of the formation of the membrane are as follows. The whole pressure is 1.5 Pa; the rate of the flow of Ar is 50 sccm; the rate of the flow of $N_2$ is 5 sccm; making high frequency power to the W target is 170 W; making high frequency power to the GeW target is 600 W; and the sheet resistance value is about $4\times10^{11}$ (Ω/□).

Figure 4A:
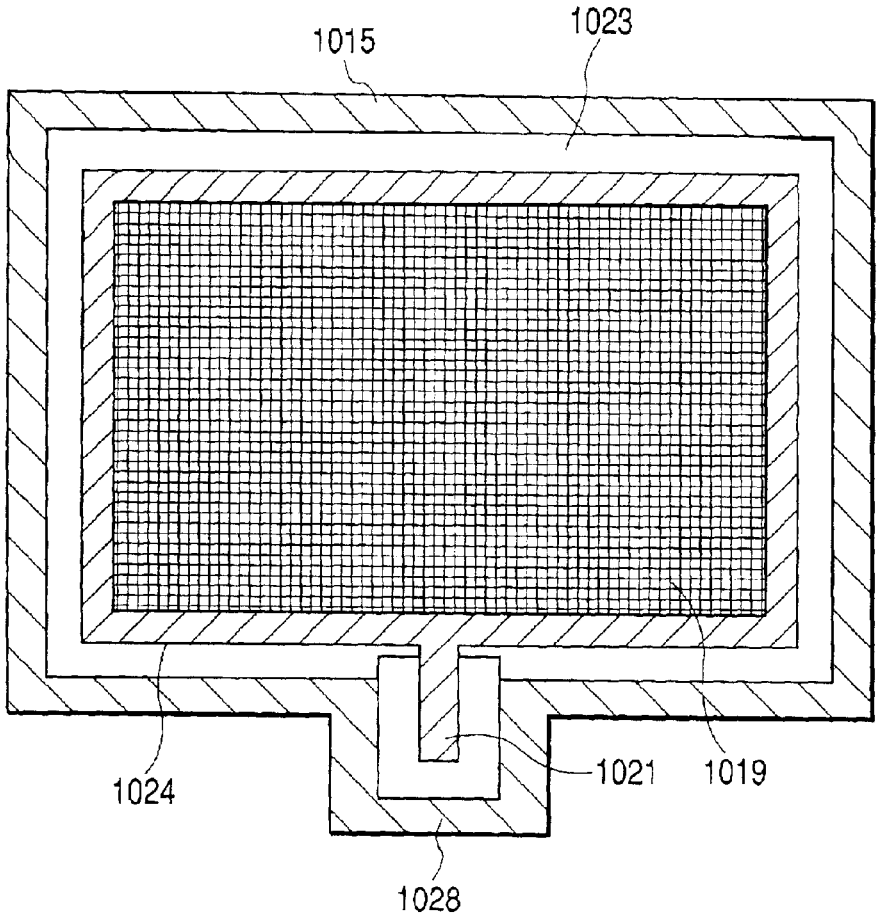
FIGS. 4A and 4B are views of the structure of electrodes on the face plate of the first embodiment of the invention.

Next, as shown in FIG. 4A, an anode peripheral portion 1024 is formed on the outside of an image displaying area 1019. The anode peripheral portion 1024 is formed by the screen printing method of a glass paste and a conductive paste containing silver grains as a layer designed to be 4 mm in width and 10 micrometers in thickness. Although the anode peripheral portion 1024 is formed by the screen printing method in the present embodiment, it is of course that the method of forming the anode peripheral portion 1024 of the invention is not limited to the screen printing method. For example, a photolithography method may be employed for the formation of the anode peripheral portion 1024. Moreover, although the glass paste and the conductive paste containing silver grains are used as the material of the anode peripheral portion 1024, it is needless to say that the material is not limited the aforesaid materials. For example, a carbon black and the like may be used.

Next, as shown in FIG. 4A, the potential regulating electrode 1015 is formed on the outside of the anode 1014 with a space of 2 mm. The potential regulating electrode 1015 is formed by the screen printing of a glass paste and a conducting paste containing silver grains as a layer designed to be 4 mm in width and 10 micrometers in thickness. Although the potential regulating electrode 1015 is formed by the screen printing method in the present embodiment, it is of course that the method of forming the potential regulating electrode 1015 of the invention is not limited to the screen printing method. For example, a photolithography method may be employed for the formation of the potential regulating electrode 1015. Moreover, although the glass paste and the conductive paste containing silver grains are used as the material of the potential regulating electrode 1015, it is needless to say that the material is not limited the aforesaid materials. For example, a carbon black and the like may be used.

Although the black matrix 1010, the anode peripheral portion 1024 and the potential regulating electrode 1015 are made at separate processes in the above, their heights is desirable to be substantially the same in consideration of the contact of the spacers 1012 to them. Accordingly, it is desirable to make the materials of at least two kinds of them, preferably three kinds of them, the same and to make them at the same time because it becomes easy to make their thicknesses even in that case. Moreover, although the potential regulating electrode 1015 is formed around the anode 1014 over its whole periphery, the way of forming the potential regulating electrode 1015 is not limited to the shape, and the potential regulating electrode 1015 may be formed only the positions where discharges to be generated between the anode 1014 and its outside becomes a problem. However, it is more preferable for pressurizing to form the potential regulating electrode 1015 over the whole periphery of the anode 1014 because electric fields outside the potential regulating electrode 1015 could be relieved better in that case.

Next, as shown in FIG. 3A, three color phosphors of a red, a blue and a green are formed one by one at three times at the opened portions of the black matrix 1010 to be about 20 $\mu$m in thickness by screen printing method with red, green and black phosphor pastes. Although the phosphor membrane 1008 is made by the screen printing method in the present embodiment, it is of course that the method of forming the phosphor membrane 1008 is not limited to the screen printing method. The phosphor membrane 1008 may be made by, for example, a photolithography method. Moreover, although P22 phosphors used in the field of CRT's, or a red phosphor (P22-RE3; $Y_2O_2S$: Eu3+), a blue phosphor (P22-B2; ZnS: Ag, Al) and a green phosphor (P22-GN4; ZnS: Cu, Al), are used in the present embodiment, it is needless to say that the phosphors are not limited to them and other phosphors may be used.

Figure 4B:
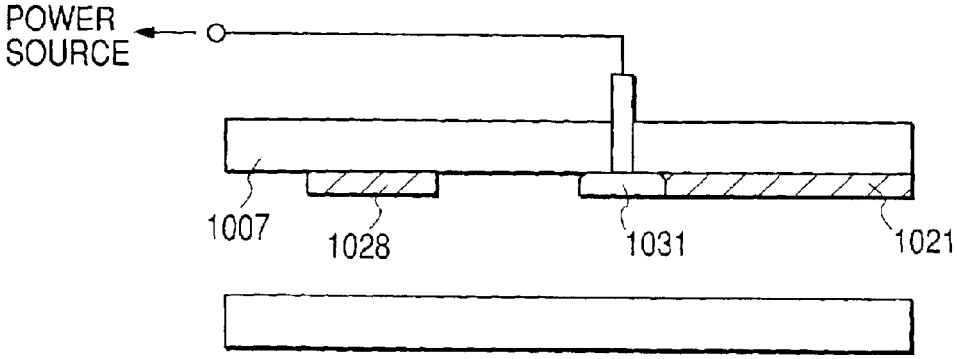

Next, a resin interlay is made by a filming process that is known in the field of Braun tubes, and a metal evaporated film is made after that. Last, the resin interlay is pyrolytically decomposed to be removed, and thereby the metal-backing 1009 is produced. The anode 1014 is formed. Moreover, a high voltage introducing terminal 1031 is provided on the face plate 1007 as shown in FIG. 4B for supplying an acceleration voltage to a high voltage taking out portion 1021 (hereupon a pulled out portion of the anode peripheral portion 1024), and the terminal Hv for leading out a high voltage is coupled with connect a high voltage power source 1020 thereto. Moreover, a taking out portion 1028 of the potential regulating electrode 1015 is connected with the earth potential.

Figure 5:
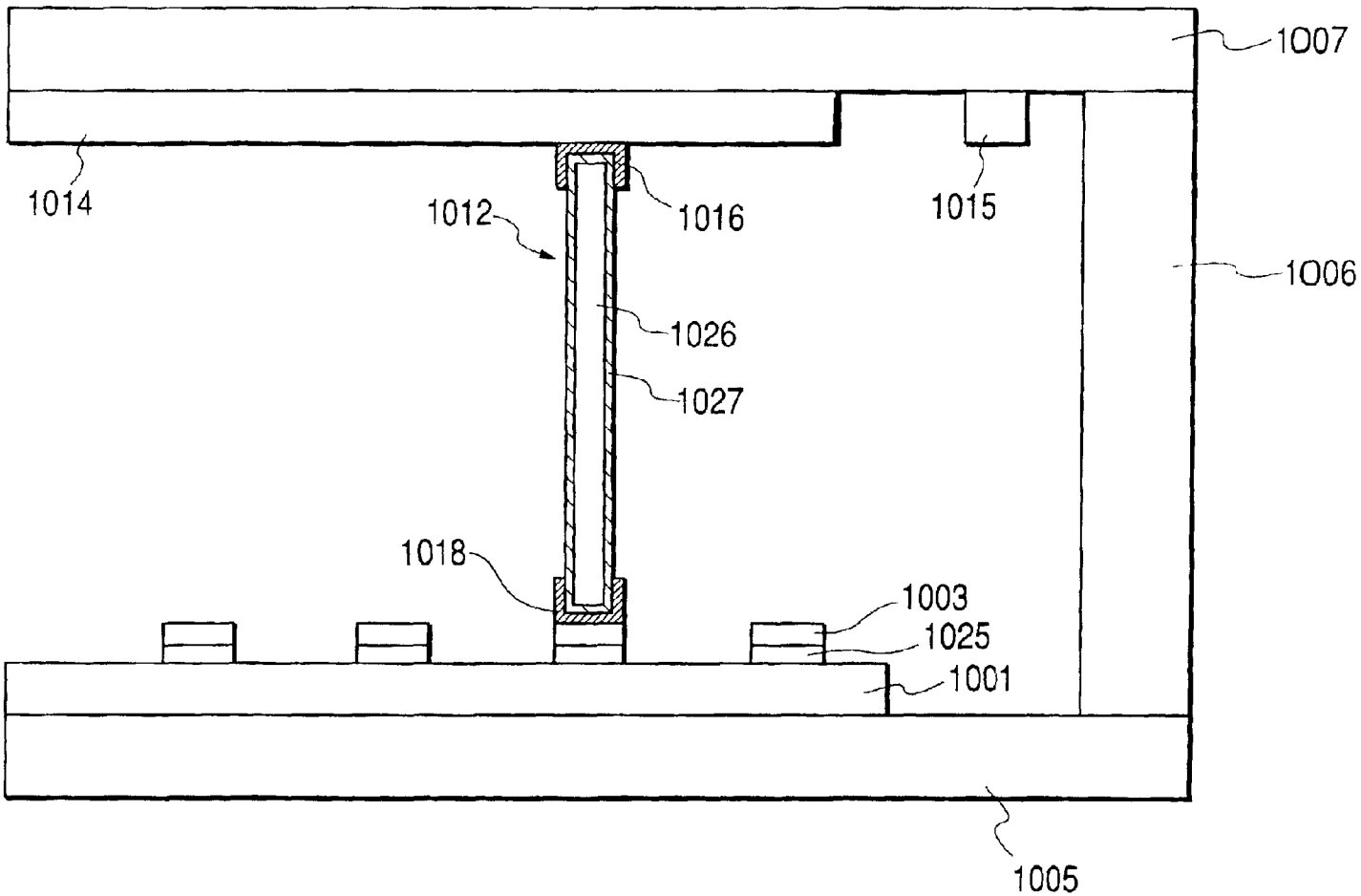
FIG. 5 is a mimetic cross section taken along the 5—5 line in FIG. 1.

Next, the structures and a manufacturing method of the spacers 1012 to be used in the image displaying panel are described by means of a concrete example. FIG. 5 is a mimetic cross section of the image displaying apparatus of FIG. 1 taken along the 5—5 line in FIG. 1. Each reference numeral of each part of the image displaying apparatus of FIG. 5 corresponds to those of FIG. 1. As the spacers 1012, spacers made by forming a high resistance membrane 1027 for the prevention of discharging on an insulating member 1026 are used. Moreover, an electrode 1016 is formed on a contact surface and side surfaces of each spacer 1012 facing the inner side (the anode 1014) of the face plate 1007 with a low resistance membrane, and an electrode 1018 is formed on the other contact surface of each spacer 1012 facing the surface (the wiring 1003 in the row directions and the wiring 1004 in the column directions) of the substrate 1001 with a low resistance membrane. Moreover, as shown in FIG. 2, the electrode 1017 is formed with a low resistance membrane on a contact surface and side surface of each spacer 1012 facing the potential regulating electrode 1015. Incidentally, the high resistance membrane may be formed on the low resistance membranes as described above.

The number of the spacers 1012 necessary for achieving the object is disposed at distances between each of them necessary for achieving the object. The spacers 1012 come in contact with the inside of the face plate 1007 and the surface of the substrate 1001. Moreover, the high resistance membrane 1027 is formed on at least a surface of the insulating member 1026 exposed in the vacuum in the hermetic package. Hereupon the high resistance membrane 1027 is electrically connected with the inside of the face plate 1007 (such as the anode 1014) and the surface of the substrate 1001 (the wiring 1003 in the row directions or the wiring 1004 in the column directions) through the electrodes 1016 and 1018 on the spacers 1012, respectively. In the embodiment described here, the shapes of the spacers 1012 are a thin plate, and the spacers 1012 are disposed in parallel to the pieces of the wiring 1003 in the rows to contact the wiring 1003 to be electrically connected with them.

As being the spacers 1012, they are required to have an electrical insulating quality to the degree of enduring the high voltage applied between the wiring 1003 in the row directions and the wiring 1004 in the column directions on the substrate 1001 and the anode 1014 on the inner surface of the face plate 1007, and the spacers 1012 are required to have electrical conductivity of the degree of preventing charging on the surfaces of the spacers 1012. Moreover, the present invention can be applied to a case where, in a structure of using a control electrode such as a grid electrode between the multi-electron beam source and the anode 1014, spacing members are provided between the control electrode and the anode 1014. In that case, the spacing members should have an electrical insulating quality to the degree of enduring the voltage between the anode 1014 and the control electrode and should have electrical conductivity of the degree of preventing charging on the surfaces of the spacers 1012. In the case where the insulating members 1026 are used as the substrates of the spacers 1012, the following materials can be cited as the insulating members 1026. That is, for example, silica glass, glass containing the decreased amount of impurities such as Na or the like, glass containing an alkali earth metal as a component for increasing its electrical insulating quality (e.g. PD 200 made by Asahi Glass Co., Ltd.), soda lime glass, a ceramics member such as alumina, and the like can be used. Incidentally, it is preferable that the coefficient of the thermal expansion of the insulating members 1026 is close to those of the members of the hermetic package and the substrate 1001. In the present embodiment, PD 200 made by Asahi Glass Co., Ltd. is used.

In the high resistance membranes 1027 constituting the spacers 1012 flows electric currents of the values obtained by dividing the potential difference between the accelerating potential Va to be applied to the face plate 1007 (the anode 1014) on the higher potential side and the electric potential on the rear plate 1005 side (or the electric potential of the potential regulating electrode 1015) being a lower potential side by the resistance values Rs of the high resistance membranes 1027 being charging prevention membranes. Accordingly, the resistance values Rs of the spacers 1012 is required to be set within a rage desirable from the viewpoints of the prevention of charging and the electrical power consumption of the apparatus. From the viewpoint of the prevention of charging, the surface resistances R/□ of the spacers 1012 are preferably $10^{14}$ Ω or less. The surface resistances R/□ are more preferably $10^{13}$ Ω or less for the obtaining of the sufficient effect of the prevention of charging. Although the lower bound of the surface resistances R/□ depends on the shapes of the spacers 1012 and the voltages applied between the spacers 1012, the lower bound is preferably $10^7$ Ω or more.

It is preferable that the thicknesses "t" of the high resistance membranes 1027 being the charging prevention membranes formed on the insulating members 1026 are within a range from 10 nm to 1 μm. Although situations differ on the surface energy of a material, the adhesion properties of the material to a substrate and the temperature of the substrate, a thin film in thickness of 10 nm or less is generally formed to be islands, and the resistance thereof is unstable and the reproducibility thereof is small. On the other hand, in the case where the thicknesses "t" of the charging prevention membranes are 1 μm or more, the stresses of the membranes are large to heighten the dangerousnesses of the peelings of the membranes. Furthermore, because the period of time for the formation of the membranes becomes long, their productivity is bad. Consequently, it is preferable that the thicknesses "t" is within a range of 50–500 nm. Because the surface resistances R/□ are ρ/t and the preferable ranges of the surface resistances R/□ and the thicknesses "t" described above, the specific resistances ρ of the charging prevention membranes are preferably within a range from 10 (Ω.cm) to $10^{10}$ (Ω.cm). Furthermore, for the realization of the more preferable ranges of the surface resistances R/□ and the thicknesses "t", the specific resistances ρ should be within a range $10^4$ to $10^8$ Ω.cm.

Because the resistance value of a nitride of an alloy of germanium and a transition metal can be controlled in a wide range from a good conductive material to an insulator by the adjustment of the composition of the transition metal, the nitride is a preferable material as another material of the high resistance membranes 1027 having the characteristic of preventing charging. Furthermore, the changes of the resistance value of the nitride in the manufacturing process of an image displaying apparatus are very few, and then the nitride is a stable material. As the transition metal can be cited Ti, V, Cr, Mn, Fe, Co, Cu, Zr, Nb, Mo, Hf, W and the like.

The nitride membrane of the alloy is formed on the insurance member by thin film forming means such as sputtering, reactive sputtering in a nitrogen gas atmosphere, electron-beam evaporation, ion plating, ion assisted deposition and the like. A metal oxide film can also be formed by similar thin film forming methods, but in this case some oxide gas is used in place of nitrogen gas. Besides, the metal oxide film can also be formed by the CVD method and an alkoxide coating method. A carbon membrane is made by the evaporation method, the sputtering method, the CVD method and the plasma CVD method. In particular, when amorphous carbon is made, hydrogen is made to be contained in the atmosphere during the formation of a membrane, or a hydrocarbon gas is used as a gas for forming a membrane.

In the present embodiment, the high resistance membranes 1027 were made by the sputtering method. The conditions for forming the membranes 1027 were as follows. The whole pressure was 1.5 Pa. The flow rate of Ar was 50 sccm. The flow rate of $N_2$ was 5 sccm. The making high frequency electric power to the W target was 180 W. The making high frequency electric power to Ge target was 600 W. A measured sheet resistance value of a produced spacer was $2\times10^{12}$ [Ω/□].

The electrodes 1016, 1018 and 1017 of the spacers 1012 are formed for connecting the spacers 1012 electrically with the face plate 1007 (the anode 1014) on the high potential side and the substrate 1001 (the wiring 1003, the wiring 1004 and the like) and potential regulating electrode 1015 on the low potential side, and a material having a resistance value lower than that of the high resistance membranes 1027 sufficiently should be selected as the material of the spacers 1027. The material can suitably be selected among the following materials: for example, metals such as Ni, Cr, Au, Mo, W, Pt, Ti, Al, Cu, Pd and the like; alloys; printing conductors composed of metals such as Pd, Ag, Au, $RuO_2$, Pd—Ag and the like, metal oxides, glasses and the like; transparent conductors such as $In_2O_3$—$SnO_2$ and the like; and semiconductor materials such as polysilicon and the like. In the present embodiment, the electrodes 1016, 1017 and 1018 were formed by sputtering low resistance membranes consisting of Ti (lower layer; 200 angstroms) and Pt (800 angstroms).

Second Embodiment

Figure 6:
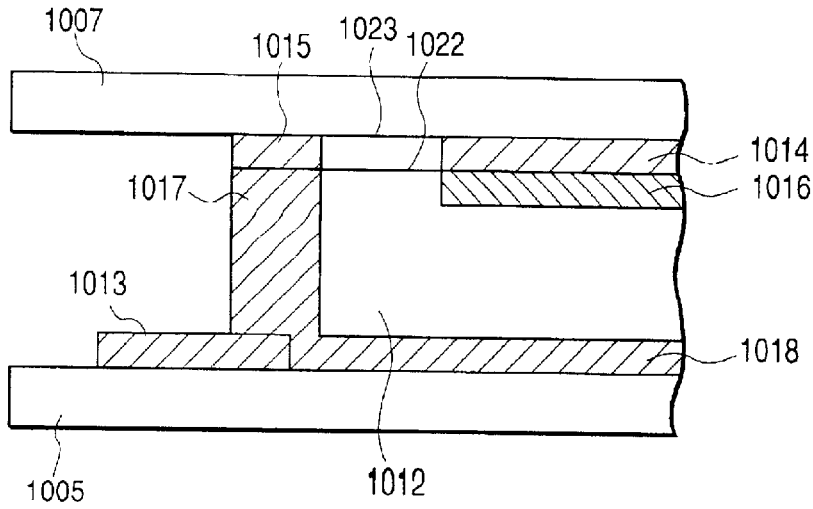
FIG. 6 is a mimetic cross section showing the structure of the principal part of a second embodiment of the present invention.

A second embodiment of the image displaying apparatus of the present invention is described next. Incidentally, because the whole structure of the image displaying apparatus is the same as that of the first embodiment, only the characteristic structures of the present embodiment are described in the following description. FIG. 6 is a mimetic cross section showing the structure of the principal part of the second embodiment of the present invention, and is a cross section of one of the spacers 1012 and the spacer fixing member 1013 thereof viewed from a direction orthogonal to the lengthwise direction of the spacer 1012 similarly to FIG. 2.

The spacer 1012 is provided with electrodes 1016, 1017 and 1018 that are severally regulated by the electric potentials at the contacting portions in the image displaying areas of the anode 1014, the potential regulating electrode 1015 and the rear plate 1005, and the electrodes 1017 and 1018 are electrically coupled with each other. Hereupon, the spacers 1012 are disposed on the pieces of wiring in the X-directions on the rear plate 1005 in the image displaying area in contact with the pieces of the wiring, and the electrodes 1018 are regulated by the electric potentials of the pieces of the wiring on the X-directions. Incidentally, in the present embodiment, for the prevention of the conduction of a plurality of pieces of the wiring in the X-directions through the potential regulating electrode 1015, at least one discontinuous portion is formed on the potential regulating electrode 1015 between the spacers 1012 adjoining to each other.

The anode 1014 and the potential regulating electrode 1015 are formed on the face plate 1007, and the accelerating potential Va is applied to the anode 1014 from a high voltage power source. The potential regulating electrode 1015 is regulated by the electric potentials of the electrodes of the wiring in the X-directions by being connected with the electrodes 1017 and 1018. Moreover, the spacer 1012 is extended from the area of the anode 1014 to the outside. The spacer 1012 contacts the anode 1014 and the potential regulating electrode 1015 on the face plate 1007. Moreover, the spacer 1012 is fixed at a predetermined position on the rear plate 1005 by the spacer fixing member 1013.

Moreover, a high resistance membrane is formed at the area 1023 between the anode 1014 and the potential regulating electrode 1015 on the face plate 1007 similarly in the first embodiment, and potentials between the anode 1014 and the potential regulating electrode 1015 are divided by resistance division to define the potential at each position. Moreover, a high resistance membrane is formed on the spacer 1012 similarly in the first embodiment, and potentials between the contact area with the anode 1014 and the contact area with the potential regulating electrode 1015 are divided by resistance division to define the potential at each position. Hereupon, because the distance of the area 1022 (or the interval between the electrodes 1016 and 1017) is made to be substantially the same as the distance of the area 1023 (or the interval between the anode 1014 and the potential regulating electrode 1015) to make the intervals agree with each other, the electric potentials at opposed parts in the areas 1022 and 1023 (the parts where the distance between the areas 1022 and 1023 becomes nearest) are made substantially the same. Consequently, potential differences are hard to generate at small gaps, and thereby high electric fields are hard to generate.

When the image displaying apparatus in such a structure was driven at an accelerating potential Va=10 kV, no discharge was observed, and a good image quality was obtained. Moreover, when an accelerating potential Va was applied to the anode 1014 in the state where the multi-electron beam source was not driven and a voltage Vb at which the image displaying apparatus began discharging as the accelerating voltage Va was gradually increased, the voltage Vb was 14.0 kV. Incidentally, the distance between the anode 1014 and the potential regulating electrode 1015 was 2 mm similarly in the first embodiment. Moreover, similarly in the first embodiment, when the inventors measured averaged heights of the black matrix 1010 at the contacting portions of the anode 1014 to the spacers 1012 from the glass surface of the face plate 1007 with a contacting type surface roughness tester, the results were that the height was 10.2 micrometers and the surface roughness was Ra=1.5 micrometers. Moreover, when the inventors measured averaged thickness of the potential regulating electrode 1015 with the contacting type surface roughness tester, the inventors obtained the results that the thickness was 9.5 micrometers and the surface roughness was Ra=1.3 micrometers.

Third Embodiment

Figure 7:
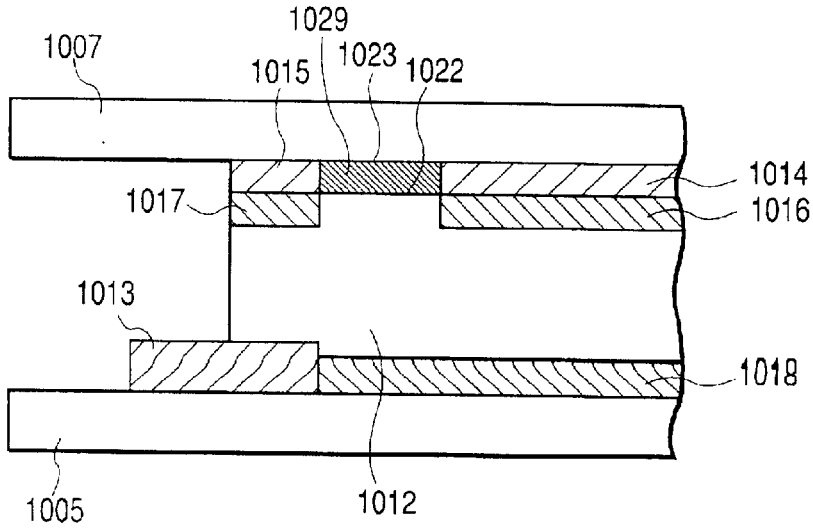
FIG. 7 is a mimetic cross section showing the structure of the principal part of a third embodiment of the present invention.

A third embodiment of the present invention is described next. Because the whole structure of the image displaying apparatus of the present embodiment is also the same as that of the first embodiment, only the characteristic structures of the present embodiment are described. FIG. 7 is a mimetic cross section showing the structure of the principal part of the third embodiment, and is a cross section of one of the spacers 1012 and the spacer fixing member 1013 thereof viewed from a direction orthogonal to the lengthwise direction of the spacer 1012.

The spacer 1012 is provided with electrodes 1016, 1017 and 1018 that are severally regulated by the electric potentials at the contacting portions in the image displaying areas of the anode 1014, the potential regulating electrode 1015 and the rear plate 1005. Hereupon, the spacers 1012 are disposed on the pieces of wiring in the X-directions on the rear plate 1005 in the image displaying area in contact with the pieces of the wiring, and the electrodes 1018 are regulated by the electric potentials of the pieces of the wiring on the X-directions. Moreover, the electrode 1017 contacts only the side of the face plate 1007.

The anode 1014 and the potential regulating electrode 1015 are formed on the face plate 1007, and the accelerating potential Va is applied to the anode 1014 from a high voltage power source. The potential regulating electrode 1015 is regulated by the earth potential. Moreover, the spacer 1012 is extended from the area of the anode 1014 to the outside. The spacer 1012 contacts the anode 1014 and the potential regulating electrode 1015 on the face plate 1007. Moreover, the spacer 1012 is fixed at a predetermined position on the rear plate 1005 by the spacer fixing member 1013.

Moreover, a member 1029 is provided at the area 1023 between the anode 1014 and the potential regulating electrode 1015 on the face plate 1007 for making the contact of the face plate 1007 with the spacer 1012 good. The member 1029 is made by the screen printing method under the designed value of 10 micrometers with a glass paste containing ruthenium tetroxide before the forming of a phosphor membrane in the face plate making process. Although the ruthenium tetroxide is used for the member 1029 hereupon, it is of course that the glass paste is not limited to it. For example, a glass plate containing carbon or the like may be used.

A high resistance membrane is formed on the spacer 1012 similarly to the first embodiment, and potentials between the anode 1014 and the potential regulating electrode 1015 are divided by resistance division to define the potential at each position. Moreover, because the heights of the anode 1014, the potential regulating electrode 1015 and the member 1029 are substantially the same, the spacer 1012 contacts all of these parts when the inside of the image displaying panel is made to be a vacuum. The potentials of the contacting points of the face plate 1007 and the spacers 1012 become substantially the same at all points.

Furthermore, when the present inventors observed the image displaying panel by analyzing the panel after its assembly to a panel and the suction of its inside to a vacuum for ascertaining the degree of the contact, the inventors could observe the traces such that the contacting portions of the anode 1014, the potential regulating electrode 1015 and the member 1029 with the spacers 1012 had been pressed by the atmospheric pressure. When the inventors measured the distances of the potions of the member 1029 that did not contact the spacers 1012, the inventors could not find any portion that did not contact the spacers 1012 for over 50 micrometers. Moreover, when the inventors measured the averaged height of the member 1029 with the contacting type surface roughness tester similarly to the first embodiment, the height was 9.8 micrometers and the surface roughness was Ra=1.6 micrometers. Moreover, when the inventors measured the sheet resistance of the member 1029, the sheet resistance was $5\times10^{10}$ (Ω/□).

Furthermore, when the inventors measured the averaged height of the black matrix 1010 at the contacting portions of the anode 1014 with the spacers 1012 from the glass surface of the face plate 1007 with the contacting type surface roughness tester, the height was 10.2 micrometers and the surface roughness was Ra=1.5 micrometers. Moreover, when the inventors measured the averaged height of the potential regulating electrode 1015 with the contacting type surface roughness tester, the height was 9.5 micrometers and the surface roughness was Ra=1.3 micrometers.

When the image displaying apparatus in such a structure was driven at an accelerating potential Va=10 kV, no discharge was observed, and a good image quality could be obtained. Moreover, when an accelerating potential Va was applied to the anode 1014 in the state that the multi-electron beam source was not driven and a voltage Vb at which the image displaying apparatus began discharging as the gradual increase of the accelerating voltage Va was obtained, the voltage Vb was 17.2 kV. Incidentally, the distance between the anode 1014 and the potential regulating electrode 1015 was 2 mm similarly in the first embodiment.

Fourth Embodiment

Figure 8:
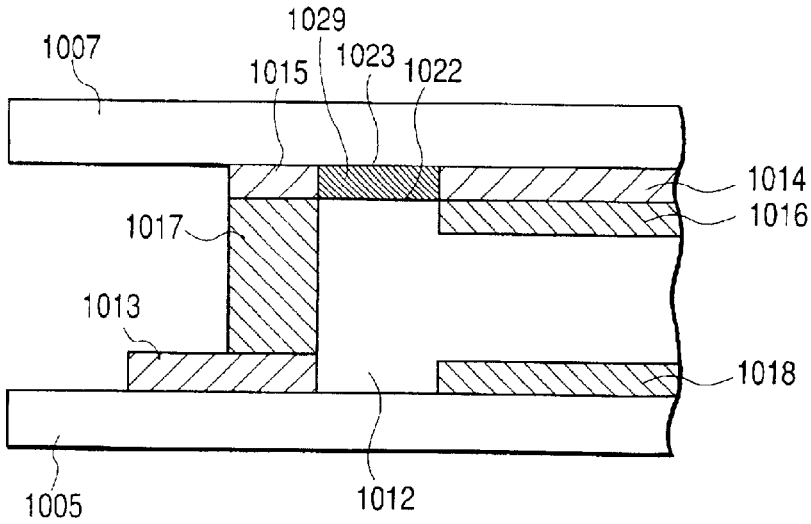
FIG. 8 is a mimetic cross section showing the structure of the principal part of a fourth embodiment of the present invention.

A fourth embodiment of the present invention is described next. Because the whole structure of the image displaying apparatus of the present embodiment is also the same as that of the first embodiment, only the characteristic structures of the present embodiment are described. FIG. 8 is a view showing the structure of the principal part of the fourth embodiment, and is a cross section of one of the spacers 1012 and the spacer fixing member 1013 thereof viewed from a direction orthogonal to the lengthwise direction of the spacer 1012.

The spacer 1012 is provided with electrodes 1016, 1017 and 1018 that are severally regulated by the electric potentials at the contacting portions in the image displaying areas of the anode 1014, the potential regulating electrode 1015 and the rear plate 1005. Hereupon, the spacers 1012 are disposed on the pieces of wiring in the X-directions on the rear plate 1005 in the image displaying area in contact with the pieces of the wiring, and the electrodes 1018 are regulated by the electric potentials of the pieces of the wiring on the X-directions.

The anode 1014 and the potential regulating electrode 1015 are formed on the face plate 1007, and the accelerating potential Va is applied to the anode 1014 from a high voltage power source. The potential regulating electrode 1015 is regulated by the earth potential. Moreover, the spacer 1012 is extended from the area of the anode 1014 to the outside. The spacer 1012 contacts the anode 1014 and the potential regulating electrode 1015 on the face plate 1007. Moreover, the spacer 1012 is fixed at a predetermined position on the rear plate 1005 by the spacer fixing member 1013.

Moreover, a member 1029 is provided at the area 1023 between the anode 1014 and the potential regulating electrode 1015 on the face plate 1007 for making the contact of the face plate 1007 with the spacer 1012 good. The member 1029 is made by the screen printing method under the designed value of 10 micrometers with a glass frit before the forming of a phosphor membrane in the face plate making process. Although the glass frit is used for the member 1029 hereupon, it is of course that the material is not limited to it. Next, a high resistance membrane is formed on the surface of the member 1029. A high resistance membrane similar to that formed on the face plate 1007 of the first embodiment is used as the high resistance membrane of the present embodiment.

Moreover, a high resistance membrane is formed on the spacer 1012 similarly to the first embodiment, and potentials between the anode 1014 and the potential regulating electrode 1015 are divided by resistance division to define the potential at each position. Moreover, because the heights of the anode 1014, the potential regulating electrode 1015 and the member 1029 are substantially the same, the spacer 1012 contacts all of these parts when the inside of the image displaying panel is made to be a vacuum. The potentials of the contacting points of the face plate 1007 and the spacers 1012 become substantially the same at all points.

Furthermore, when the present inventors observed the image displaying panel by analyzing the panel after its assembly to a panel and the suction of its inside to a vacuum for ascertaining the degree of the contact, the inventors could observe the traces such that the contacting portions of the anode 1014, the potential regulating electrode 1015 and the member 1029 with the spacers 1012 had been pressed by the atmospheric pressure, which indicated that the contacting portions were in good contacting state. Moreover, when the inventors measured the averaged height of the member 1029 with the contacting type surface roughness tester similarly to the first embodiment, the height was 10.4 micrometers and the surface roughness was Ra=1.0 micrometers.

Moreover, when the inventors measured the resistance of the high resistance membrane on the surface of the member 1029, the sheet resistance of the membrane was $5\times10^{11}$ (Ω/□). Furthermore, when the inventors measured the averaged height of the black matrix 1010 at the contacting portions of the anode 1014 with the spacers 1012 from the glass surface of the face plate 1007 with the contacting type surface roughness tester, the height was 10.2 micrometers and the surface roughness was Ra=1.5 micrometers. Moreover, when the inventors measured the averaged height of the potential regulating electrode 1015 with the contacting type surface roughness tester, the height was 9.5 micrometers and the surface roughness was Ra=1.3 micrometers.

When the image displaying apparatus in such a structure was driven at an accelerating potential Va=10 kV, no discharge was observed, and a good image quality could be obtained. Moreover, when an accelerating potential Va was applied to the anode 1014 in the state that the multi-electron beam source was not driven and a voltage Vb at which the image displaying apparatus began discharging as the gradual increase of the accelerating voltage Va was obtained, the voltage Vb was 18.0 kV. Incidentally, the distance between the anode 1014 and the potential regulating electrode 1015 was 2 mm similarly in the first embodiment.

Fifth Embodiment

Figure 9:
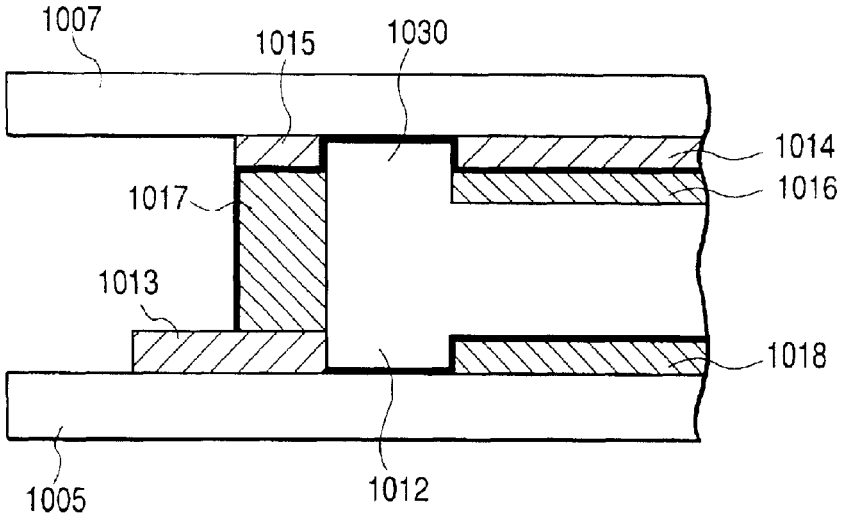
FIG. 9 is a mimetic cross section showing the structure of the principal part of a fifth embodiment of the present invention.

A fifth embodiment of the present invention is described next. Because the whole structure of the image displaying apparatus of the present embodiment is also the same as that of the first embodiment, only the characteristic structures of the present embodiment are described. FIG. 9 is a mimetic cross section showing the structure of the principal part of the fifth embodiment, and is a cross section of one of the spacers 1012 and the spacer fixing member 1013 thereof viewed from a direction orthogonal to the lengthwise direction of the spacer 1012.

The spacer 1012 is provided with electrodes 1016, 1017 and 1018 that are severally regulated by the electric potentials at the contacting portions in the image displaying areas of the anode 1014, the potential regulating electrode 1015 and the rear plate 1005. Hereupon, the spacers 1012 are disposed on the pieces of wiring in the X-directions on the rear plate 1005 in the image displaying area in contact with the pieces of the wiring, and the electrodes 1018 are regulated by the electric potentials of the pieces of the wiring on the X-directions. Moreover, a projecting configuration 1030 for contacting the face plate 1007 is formed at a portion of the spacer 1012 between the anode 1014 and the potential regulating electrode 1015. A ceramic of alumina is used as the material of the spacer 1012 with the projecting configuration. As for the shape of the projection configuration, the height of the projection is 10 micrometers and the width thereof is 2 mm.

The anode 1014 and the potential regulating electrode 1015 are formed on the face plate 1007, and the accelerating potential Va is applied to the anode 1014 from a high voltage power source. The potential regulating electrode 1015 is regulated by the earth potential. The spacer 1012 is extended from the area of the anode 1014 to the outside. The spacer 1012 contacts the anode 1014 and the potential regulating electrode 1015 on the face plate 1007. Moreover, the spacer 1012 is fixed at a predetermined position on the rear plate 1005 by the spacer fixing member 1013.

High resistance membranes are formed on the spacer 1012 and the face plate 1007 similarly to the first embodiment, and potentials between the anode 1014 and the potential regulating electrode 1015 are divided by resistance division to define the potential at each position. Because the projecting configuration 1030 for contacting the face plate 1007 is formed in the present embodiment, the spacer 1012 contacts all of these parts when the inside of the image displaying panel is made to be a vacuum. The potentials of the contacting points of the face plate 1007 and the spacers 1012 become substantially the same at all points.

Hereupon, when the present inventors observed the image displaying panel by analyzing the panel after its assembly to a panel and the suction of its inside to a vacuum for ascertaining the degree of the contact, the inventors could observe the traces such that the contacting portions of the anode 1014 and the potential regulating electrode 1015 with the spacers 1012 had been pressed by the atmospheric pressure, and could observe scratches at the portions of the high resistance membrane of the face plate 1007 where the membrane contacted the spacers 1012. These traces and scratches indicated that the portions contacted with the spacers 1012. Moreover, when the inventors measured the averaged height of the black matrix 1010 at the contacting portions of the anode 1014 with the spacers 1012 from the glass surface of the face plate 1007 with the contacting type surface roughness tester similarly in the first embodiment, the height was 10.2 micrometers and the surface roughness was Ra=1.5 micrometers. Moreover, when the inventors measured the averaged height of the potential regulating electrode 1015 with the contacting type surface roughness tester, the height was 9.5 micrometers and the surface roughness was Ra=1.3 micrometers.

When the image displaying apparatus in such a structure was driven at an accelerating potential Va=10 kV, no discharge was observed, and a good image could be obtained. Moreover, when an accelerating potential Va was applied to the anode 1014 in the state that the multi-electron beam source was not driven and a voltage Vb at which the image displaying apparatus began discharging as the gradual increase of the accelerating voltage Va was obtained, the voltage Vb was 14.0 kV. Incidentally, the distance between the anode 1014 and the potential regulating electrode 1015 was 2 mm similarly in the first embodiment.

COMPARATIVE EXAMPLE

Figure 10:
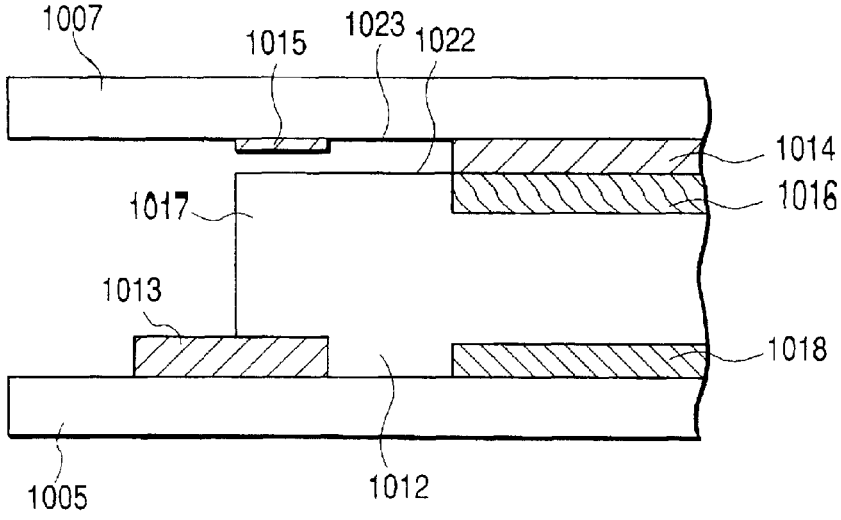
FIG. 10 is a mimetic cross section showing an comparison example to the present invention.
Figure 11:
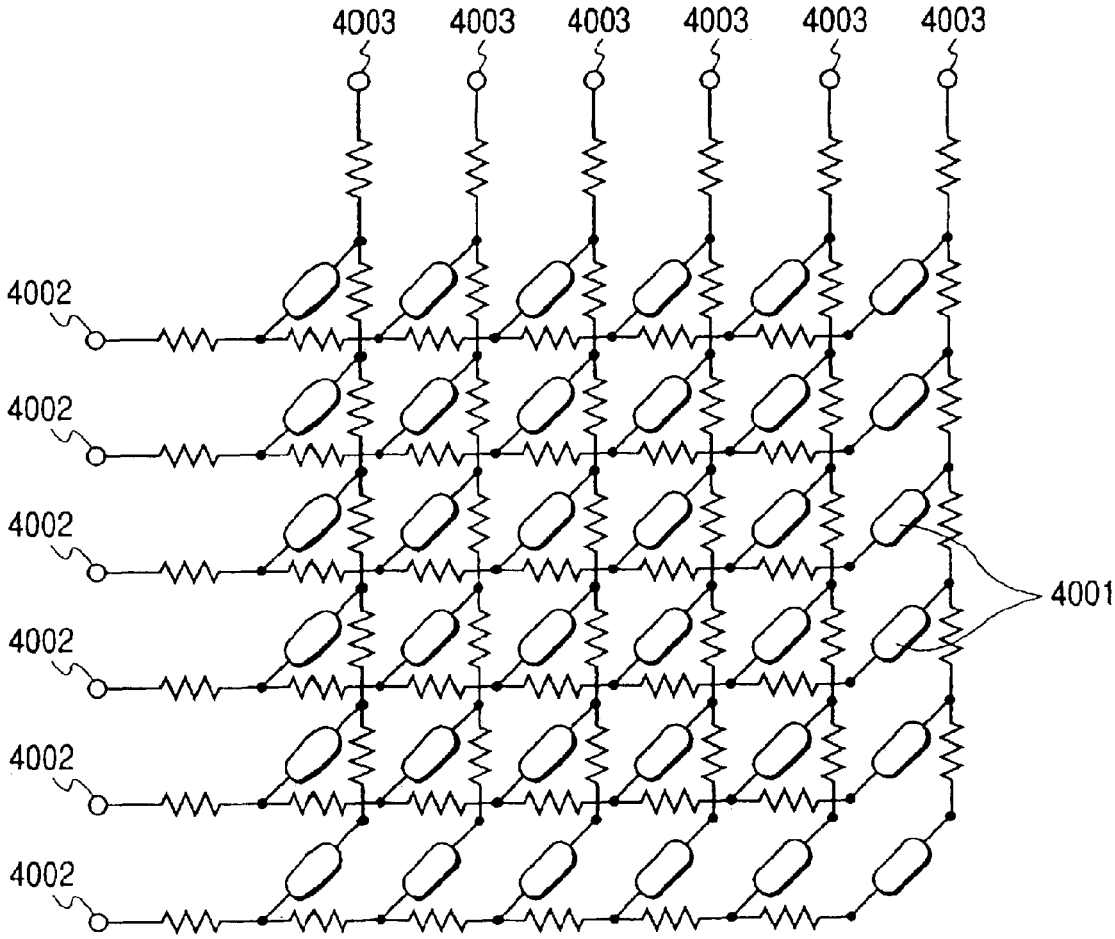
FIG. 11 is a diagram showing an example of an image displaying apparatus using a multi-electron beam source in which surface conduction electron-emitting devices are arranged in a matrix.
Figure 12:
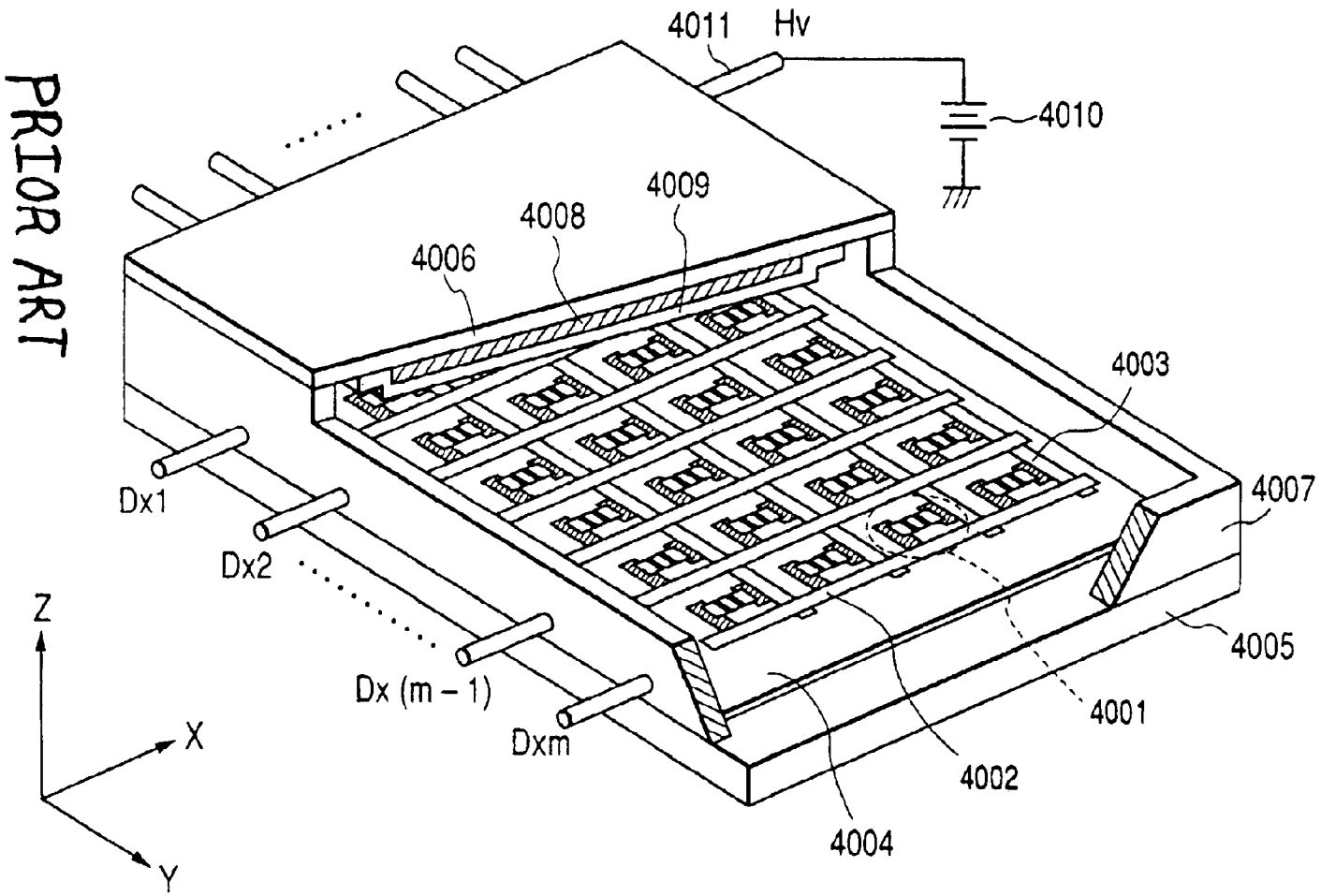
FIG. 12 is a partially broken perspective view showing an image displaying panel of an image displaying apparatus using the multi-electron beam source of FIG. 11.

Next, a comparative example of the present invention is described. In the comparative example, too, because the same whole structure of the image displaying apparatus as that of the first embodiment was used, only the characteristic structures of the comparative example are described. Incidentally, as the comparative example, an example in which the spacers 1012 do not contact the potential regulating electrode 1015 was used for the comparison with the embodiments described above. FIG. 10 is a mimetic cross section showing the comparative example, and is a cross section of part of one of the spacers 1012 and the spacer fixing member 1013 thereof viewed from a direction orthogonal to the lengthwise direction of the spacer 1012.

The anode 1014 and the potential regulating electrode 1015 are formed on the face plate 1007, and the accelerating potential Va is applied to the anode 1014 from a high voltage power source. The potential regulating electrode 1015 is connected with the earth potential to be regulated by the earth potential. The spacer 1012 is extended from the area of the anode 1014 to the outside. The spacer 1012 contacts the anode 1014 on the face plate 1007, but the spacer 1012 does not contact the potential regulating electrode 1015. Moreover, the spacer 1012 is fixed at a predetermined position on the rear plate 1005 by the spacer fixing member 1013.

The electrodes 1016 and 1018 regulated by the potentials of the contacting portions of the anode 1014 and the rear plate 1005, respectively, in the image displaying area are formed. Moreover, the spacers 1012 are disposed on the pieces of wiring in the X-directions on the rear plate 1005 in the image displaying area in contact with the pieces of the wiring, and the electrodes 1018 are regulated by the electric potentials of the pieces of the wiring on the X-directions.

Hereupon, when the inventors measured the averaged height of the black matrix 1010 at the contacting portions of the anode 1014 with the spacers 1012 from the glass surface of the face plate 1007 with the contacting type surface roughness tester, the height was 10.2 micrometers and the surface roughness was Ra=1.5 micrometers. Moreover, when the inventors measured the averaged height of the potential regulating electrode 1015 with the contacting type surface roughness tester, the height was 4.5 micrometers and the surface roughness was Ra=0.5 micrometers.

Moreover, when the present inventors observed the image displaying panel by analyzing the panel after its assembly to a panel and the suction of its inside to a vacuum for ascertaining the degree of the contact of the face plate 1007 with the spacers 1012, the inventors could observe the traces such that the contacting portions of the anode 1014 with the spacers 1012 had been pressed by the atmospheric pressure, which indicated that those portions contacted. However, no traces could be observed at the portions of the potential regulating electrode 1015 and it was apparent that the portions did not contact. When the image displaying apparatus in such a structure was driven at an accelerating potential Va=10 kV, discharges were frequently generated, and image qualities greatly deteriorated. Moreover, when an accelerating potential Va was applied to the anode 1014 in the state that the multi-electron beam source was not driven and a voltage Vb at which the image displaying apparatus began discharging as the gradual increase of the accelerating voltage Va was obtained, the voltage Vb was 7.6 kV.

Next, the operation of the first to the fifth embodiments is described. At first, because the embodiments have the structure in which the spacers 1012 contact both of the anode 1014 and the potential regulating electrode 1015 to be connected with them electrically, the electric field in the area at the outside of the potential regulating electrode 1015 can be relieved. Thereby, any electric field that generates abnormal discharges in the structures in the area at the outside of the potential regulating electrode 1015 is not generated, and it is possible to remove the discharges owing to those structures. Consequently, the deterioration of image qualities owing to the generation of discharges can be prevented, and an image displaying apparatus having a good image quality and high reliability can be realized. Moreover, because the potentials of the spacers 1012 can surely regulated by the equipment of the electrodes 1016–1018 on the spacers 1012 to contact the anode 1014 and the potential regulating electrode 1015 for connecting the spacer 1012 with them electrically, the potential difference between the face plate 1007 at the outside of the image displaying area and the spacers 1012 is hard to generate even if differences exist in the structures and the materials between the face plate 1007 and the spacers 1012. Consequently, the frequency of discharges can be relieved.

Moreover, in particular, because the spacers 1012 have the electrodes 1016–1018 connected with the potential regulating electrode 1015 electrically by contacting (or being disposed close to) the potential regulating electrode 1015, the potentials not only at the contact points of the spacers 1012 with the potential regulating electrode but also at the electrode portions can surely be regulated. Consequently, the portions where electrical potentials are not stabilized owing to contact failures can be removed. Now, the electrodes 1016–1018 have an object to make the potentials at the electrode parts substantially even, and the object can be achieved as long as the electrodes 1016–1018 have resistances lower than those of the structures around the electrodes 1016–1018. Moreover, when the spacers 1012 have the electrodes 1017 contacting both of the face plate 1007 and the rear plate 1005, either of the face plate 1007 and the rear plate 1005 can regulate the electric potentials of the spacers 1012. Consequently, only one of the face plate 1007 and the rear plate 1005 can be equipped as the electrode for regulating the potentials of the spacers 1012, and thereby the structure of the electrodes can be simplified.

Moreover, when the spacers 1012 have the electrodes 1016 contacting or being disposed close to the anode 1014 thereby electrically connected with the anode 1014, the potentials not only at the contacting points with the anode 1014 but also at the portions of the electrodes 1016 can be regulated. Consequently, the portions where electrical potentials are not stabilized owing to contact failures can be removed. Moreover, when the spacers 1012 have the electrodes 1018 having the potential equal to those of the rear plate 1005 at the portions of the electrodes 1018 contacting the rear plate 1005 in the image displaying area, it is possible to regulate the potentials not only at the points of the spacers 1012 contacting the rear plate 1005 but also at the portions of the electrodes 1018. Consequently, the portions where electrical potentials are not stabilized owing to contact failures can be removed.

Moreover, when the structure in which the potential of the potential regulating electrode 1015 is regulated to be equal to the potentials at the portions of the spacers 1012 contacting the rear plate 1005 in the image displaying area is employed and the electrodes 1017 of the spacers 1012 at the portions contacting the potential regulating electrode 1015 and the electrodes 1018 of the spacers 1012 at the portions contacting the rear plate 1005 are connected, the structure of the image displaying panel can be simplified. Moreover, when the potential of the potential regulating electrode 1015 is made to be the earth potential, no power supply is required for regulating the potential of the potential regulating electrode 1015, which simplifies the structure of the image displaying panel.

Furthermore, when the averaged height of the portions of the anode 1014 contacting the spacers 1012 is indicated by Da, and the surface roughnesses of the portions are indicated by Ra, and the averaged height of the portions of the potential regulating electrode 1015 contacting the spacers 1012 is indicated by Db, and the surface roughnesses of the portions are indicated by Rb, the contact of the spacers 1012 with the anode 1014 and the potential regulating electrode 1015 can be made to be good and thereby it can be prevented that electrical potentials become unstable owing to contact failures by the settings of the aforesaid averaged heights Da and Db and the surface roughnesses Ra and Rb to meet the following conditions.

$|Da-Db| \leqq 2Ra$, and $|Da-Db| \leqq 2Rb$.

Moreover, when the sheet resistance of at least the area 1023 of the face plate 1007 between the anode 1014 and the potential regulating electrode 1015 is made to be within a range of $10^7$ (Ω/□) to $10^{14}$ (Ω/□, the resistance distributions of the areas 1023 between the anode 1014 and the potential regulating electrode 1015 on the face plate 1007 can be regulated by resistance division. Consequently, concentrations in the electric field can be relieved.

Moreover, when at least the area 1023 between the anode 1014 and the potential regulating electrode 1015 on the face plate 1007 has a high resistance membrane, the potential distribution in the area 1023 between the anode 1014 and the potential regulating electrode 1015 on the face plate 1007 can be regulated by resistance division even if the face plate 1007 is composed of an insulator. Consequently, concentrations in the electric field can be relieved. Moreover, when the sheet resistance of at least the area 1023 of the spacers 1012 between the anode 1014 and the potential regulating electrode 1015 is made to be within a range of $10^7$ (Ω/□) to $10^{14}$ (Ω/□), the resistance distributions of the areas 1023 between the anode 1014 and the potential regulating electrode 1015 on the spacers 1012 can be regulated by resistance division. Consequently, concentrations in the electric field can be relieved.

Moreover, when at least the areas 1023 between the anode 1014 and the potential regulating electrode 1015 on the spacers 1012 are made to have high resistance membranes, the electric potential distributions of the areas 1023 between the anode 1014 and the potential regulating electrode 1015 on the spacers 1012 can be regulated by resistance division. Consequently, concentrations in the electric field can be relieved.

Moreover, when at least one place where the face plate 1007 and each of the spacers 1012 contact between the potential regulating electrode 1015 and the anode 1014 on the face plate 1007 is formed, the potentials of the face plate 1007 and each of the spacers 1012 at the contacting portions can be made equal. Consequently, the potential differences and the electric fields in the areas 1023 between the potential regulating electrode 1015 and the anode 1014 are relieved to make it possible to suppress discharges in the areas 1023. Moreover, by the formation of the member 1029 contacting the spacers 1012 in the area 1023 between the anode 1014 and the potential regulating electrode 1015 on the face plate 1007, the face plate 1007 and the spacers 1012 contact in good states and the potentials at the contacting portions can be equal eve if the anode 1014 and the potential regulating electrode 1015 have thicknesses in a degree of forming gaps between the spacers 1012 and the face plate 1007.

Moreover, when the averaged height of the member 1029 of the face plate 1007 contacting the spacers 1012 is indicated by Dc, and the averaged height of the portions of the anode 1014 contacting the spacers 1012 is indicated by Da, and the surface roughnesses of the portions are indicated by Ra, and the averaged height of the portions of the potential regulating electrode 1015 contacting the spacers 1012 is indicated by Db, and the surface roughnesses of the portions are indicated by Rb, the contact of the spacers 1012 with the face plate 1007 can be made to be good and thereby the electrical potentials at the contacting portions can be made equal by the settings of the aforesaid averaged heights Dc, Da and Db and the surface roughnesses Ra and Rb to meet at least one of the following two formulae.

$|Da-Dc| \leqq 2Ra$, $|Db-Dc| \leqq 2Rb$.

Moreover, when the member 1029 of the face plate 1007 contacting the spacers 1012 is composed of a high resistance material, concentration in the electric field can be prevented by the application of a suitable electric potential, and the charging on the surface of the member 1029 owing to the collisions of field-emitted electrons can be prevented. Moreover, by the formation of a high resistance membrane having a volume resistivity lower than that of the member 1029 on the surface of the member 1029 of the face plate 1007 contacting the spacers 1012, the volume resistivity in the vicinity of the surface of the member 1029 can be decreased without the large increase of the current value flowing between the anode 1014 and the potential regulating electrode 1015, which makes it possible to improve the function of preventing charging.

Moreover, by the provision of projecting configurations 1030 to the spacers 1012 for contacting the areas of the face plate 1007 between the anode 1014 and the potential regulating electrode 1015, the face plate 1007 and the spacers 1012 contact in good states and the potentials at the contacting portions can be equal. Moreover, by the equipment of the high resistance membrane of the spacers 1012, concentration in the electric field can be prevented by the application of a suitable electric potential, and the charging on the surface of the projecting configurations 1030 owing to field-emitted electrons can be prevented. Moreover, by the setting of the sheet resistances of the high resistance membranes of the spacers 1012 to be within a range of $1\times10^{7}$ (Ω/□) to $1\times10^{14}$ (Ω/□), concentration in the electric field can be prevented by the application of a suitable electric potential, and the charging on the surface of the projecting configurations 1030 owing to field-emitted electrons can be prevented.

As described above, according to the present invention, the generations of undesirable discharges can be prevented, and an image displaying apparatus that can display high quality images and has improved durability and reliability can be realized.

Although the invention has been described in its preferred form with a certain degree of particularity, obviously many changes and variations are possible therein. It is therefore to be understood that the present invention may be practiced than as specifically described herein without departing from scope and the spirit thereof.

What is claimed is:

1. An image displaying apparatus comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode and around the anode; and a spacing member provided between said first and second plates, said spacing member contacting both of the anode and the potential regulating electrode, said spacing member including an electrode, which is spaced from the anode, contacting or being disposed close to the potential regulating electrode thereby electrically connected with the potential regulating electrode.

2. An image displaying apparatus according to claim 1, wherein said spacing member further includes an electrode contacting or being disposed close to the anode thereby electrically connected with the anode.

3. An image displaying apparatus according to claim 1, wherein said spacing member further includes an electrode contacting or being disposed close to the electrode disposed on said first plate side to be electrically connected with the electrode.

4. An image displaying apparatus according to claim 1, wherein an earth potential is supplied to the potential regulating electrode.

5. An image displaying apparatus according to claim 1, wherein an electric potential equal to or lower than a lowest electric potential among electric potentials supplied to the electron beam source is supplied to the potential regulating electrode or more.

6. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein:

the anode includes an image area in which a phosphor emits light by being irradiated with electrons from the electron beam source, and when an averaged height of a portion of the anode contacting the spacing member on an outside of the image area is indicated by Da, and a surface roughness of the portion is indicated by Ra, and an averaged height of a portion of the potential regulating electrode contacting the spacing member is indicated by Db, and a surface roughness of the portion is indicated by Rb, the averaged heights Da and Db and the surface roughnesses Ra and Rb meet following conditions:

$$|Da-Db|\leqq 2Ra, \text{ and } |Da-Db|\leqq 2Rb.$$

7. An image displaying apparatus according to claim 1, wherein at least an area of said second plate between the anode and the potential regulating electrode has a sheet resistance within a range of $10^{7}$ (Ω/□) to $10^{4}$ (Ω/□).

8. An image displaying apparatus according to claim 1, wherein a high resistance membrane is formed at least in an area of said second plate between the anode and the potential regulating electrode.

9. An image displaying apparatus according to claim 1, wherein an area having a sheet resistance within a range of $10^{7}$ (Ω/□) to $10^{14}$ (Ω/□) exists on the spacing member at least between a portion thereof contacting the anode and a portion thereof contacting the potential regulating electrode.

10. An image displaying apparatus according to claim 1, wherein a high resistance membrane is formed on the spacing member at least between a portion thereof contacting the anode and a portion thereof contacting the potential regulating electrode.

11. An image displaying apparatus according to claim 1, wherein:

the spacing member includes an electrode contacting or being disposed close to the anode thereby electrically coupled with the anode and an electrode contacting or being disposed close to the potential regulating electrode thereby electrically connected with the potential regulating electrode; and an area between the electrode contacting or being disposed close to the anode thereby electrically coupled with the anode and the electrode contacting or being disposed close to the potential regulating electrode thereby electrically connected with the potential regulating electrode has a sheet resistance within a range of $10^7$ (Ω/□) to $10^{14}$ (Ω/□).

12. An image displaying apparatus according to claim 1, wherein the spacing member includes an electrode contacting or being disposed close to the anode thereby electrically coupled with the anode, an electrode contacting or being disposed close to the potential regulating electrode thereby electrically connected with the potential regulating electrode and a high resistance membrane contacting or being disposed close to each of the electrode contacting or being disposed close to the anode thereby electrically coupled with the anode and the electrode contacting or being disposed close to the potential regulating electrode thereby electrically connected with the potential regulating electrode thereby electrically connected with them.

13. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein:

the spacing member includes an electrode contacting or being disposed close to the anode thereby electrically coupled with the anode and an electrode contacting or being disposed close to the potential regulating electrode thereby electrically connected with the potential regulating electrode, and an interval between the electrode contacting or being disposed close to the anode thereby electrically coupled with the anode and the electrode contacting or being disposed close to the potential regulating electrode thereby electrically connected with the potential regulating electrode is substantially the same as an interval between the anode and the potential regulating electrode.

14. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein an interval between a projective position of an extreme point on the anode side of the potential regulating electrode to the spacing member and a position of an extreme point on the anode side of an electrode contacting or being disposed close to the potential regulating electrode of the spacing member thereby electrically connected with the potential regulating electrode is ten percent or less of an interval between the potential regulating electrode and the anode.

15. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein:

the spacing member includes an electrode contacting or being disposed close to the anode thereby electrically connected with the anode; and an interval between a projective position of an extreme point on the potential regulating electrode side of the anode to the spacing member and a position of an extreme point on the potential regulating electrode side of the electrode of the spacing member, the electrode contacting or being disposed close to the anode thereby electrically connected with the anode, is ten percent or less of an interval between the potential regulating electrode and the anode.

16. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein at least a part of said second plate and the spacing member contacts between the potential regulating electrode and the anode of said second plate.

17. An image displaying apparatus according to claim 1, wherein a structure contacting the spacing member is provided in an area between the anode and the potential regulating electrode of said second plate.

18. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein a structure contacting the spacing member is provided in an area between the anode and the potential regulating electrode of said second plate, and wherein, when an averaged height of said structure contacting the spacing member of said second plate is indicated by Dc, and an averaged height of a portion of the anode contacting the spacing member is indicated by Da, and a surface roughness of the portion is indicated by Ra, and an averaged height of a portion of the potential regulating electrode contacting the spacing member is indicated by Db, and a surface roughness of the portion is indicated by Rb, the averaged heights Dc, Da and Db and the surface roughnesses Ra and Rb meet at least one of following formulae:

$$|Da-Dc| \leqq 2Ra, \ |Db-Dc| \leqq 2Rb.$$

19. An image displaying apparatus according to claim 17, wherein said structure contacting the spacing member is composed of a high resistance material.

20. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein a structure contacting the spacing member is provided in an area between the anode and the potential regulating electrode of said second plate, and wherein a high resistance membrane having a volume resistivity lower than that of said structure is formed on a surface of said structure contacting the spacing member.

21. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein the spacing member has a structure for contacting an area between the anode and the potential regulating electrode of said second plate.

22. An image displaying apparatus, comprising:

a first plate including at least an electron beam source;

a second plate including an anode to which an electric potential for accelerating an electron beam from the electron beam source is applied, and a potential regulating electrode to which a predetermined electric potential lower than that of the anode is applied, the potential regulating electrode being situated at an outside of the anode; and a spacing member provided between said first and second plates, said spacing member contacting both of the anode and the potential regulating electrode, said spacing member including an electrode contacting or being disposed close to the potential regulating electrode, thereby being electrically connected with the potential regulating electrode, wherein the spacing member has a structure for contacting an area between the anode and the potential regulating electrode of said second plate, and wherein said structure of the spacing member for contacting the area between the anode and the potential regulating electrode of said second plate is a projecting configuration.

23. An image displaying apparatus according to claim 1, wherein the spacing member includes a high resistance membrane.

24. An image displaying apparatus according to claim 23, wherein a sheet resistance of the high resistance membranes of the spacing member is within a range of $1\times10^{7}$ (Ω/□) to $1\times10^{14}$ (Ω/□).

25. An image displaying apparatus according to claim 1, wherein the electron beam source provided on said first plate is disposed in a matrix.

26. An image displaying apparatus according to claim 1, wherein the electron beam source is composed of surface conduction electron-emitting devices.

27. An image display apparatus according to claim 1, wherein the potential regulating electrode surrounds completely the anode.

* * * * *

UNITED STATES PATENT AND TRADEMARK OFFICE

CERTIFICATE OF CORRECTION

PATENT NO. : 6,803,717 B2
DATED : October 12, 2004
INVENTOR(S) : Tomoya Ohnishi

It is certified that error appears in the above-identified patent and that said Letters Patent is hereby corrected as shown below:

Delete Drawing Sheets 2, 8, 9 and 10 consisting of FIGS. 2, 11, 12 and 13, and replace with the attached drawings.

Column 1,
Line 24, “inventors” should read -- inventor --;
Line 25, “have” should read -- has --; and
Lines 29 and 32, “inventors have” should read -- inventor has --.

Column 2,
Line 53, “inventors” should read -- inventor --.

Column 3,
Line 42, “may-preferably” should read -- may preferably --, and “include” should read -- includes --.
Line 54, “referred” should read -- referred to --; and
Line 56, “(hereupon” should read -- (hereinafter, --.

Column 4,
Line 52, “Hereupon,” should read -- Hereinafter, --.

Column 6,
Line 45, “an” should read -- a --.

Column 7,
Line 4, “membrane is” should read -- membrane --; and
Line 24, “an” should read -- a --.

Column 8,
Line 32, “referred” should read -- referred to --; and
Line 36, “fist” should read -- first --.

Column 9,
Line 21, “ordinary” should read -- ordinarily --.

Column 10,
Line 54, “is” should read -- are --; and
Line 56, “electrode” should read -- electrodes --.

Column 11,
Lines 58 and 61, “inventors” should read -- inventor --.

UNITED STATES PATENT AND TRADEMARK OFFICE

CERTIFICATE OF CORRECTION

PATENT NO. : 6,803,717 B2
DATED : October 12, 2004
INVENTOR(S) : Tomoya Ohnishi

It is certified that error appears in the above-identified patent and that said Letters Patent is hereby corrected as shown below:

Column 12,
Lines 1, 7 and 10, “inventors” should read -- inventor --.

Column 13,
Line 37, “a” should read -- an --.

Column 15,
Line 11, “limited” should read -- limited to --; and
Line 58, “(hereupon” should read -- (hereinafter, --.

Column 17,
Line 8, “rage” should read -- range --.

Column 19,
Lines 36, 42 and 45, “inventors” should read -- inventor --.

Column 20,
Line 23, “plate” should read -- paste --;
Lines 36, 39, 43, 45, 47, 52, 54 and 60, “inventors” should read -- inventor --; and
Line 44, “potions” should read -- portions --.

Column 21,
Lines 64 and 67, “inventors” should read -- inventor --.

Column 22,
Lines 6, 11 and 14, “inventors” should read -- inventor --.

Column 23,
Lines 18, 21, 29 and 35, “inventors” should read -- inventor --.

Column 24,
Lines 18, 24, 28 and 32, “inventors” should read -- inventor --; and
Line 62, “surely” should read -- surely be --.

Column 26,
Line 5, “(Ω/□,” should read -- (Ω/□), --; and
Line 47, “eve” should read -- even --.

UNITED STATES PATENT AND TRADEMARK OFFICE

CERTIFICATE OF CORRECTION

PATENT NO. : 6,803,717 B2
DATED : October 12, 2004
INVENTOR(S) : Tomoya Ohnishi

It is certified that error appears in the above-identified patent and that said Letters Patent is hereby corrected as shown below:

Column 27,
Line 40, "than" should read -- other than --.

Column 28,
Line 43, "$10^4$ (Ω/□)." should read -- $10^{14}$ (Ω/□). --.

Signed and Sealed this

Thirteenth Day of December, 2005

JON W. DUDAS
*Director of the United States Patent and Trademark Office*